US009332799B1

(12) United States Patent
Wenner

(10) Patent No.: US 9,332,799 B1
(45) Date of Patent: May 10, 2016

(54) PROTECTIVE APPARATUS AND METHOD FOR DISSIPATING FORCE

(71) Applicant: Helmet Technologies LLC, Novi, MI (US)

(72) Inventor: Justin B. Wenner, Los Angeles, CA (US)

(73) Assignee: Helmet Technologies LLC, Novi, MI (US)

( * ) Notice: Subject to any disclaimer, the term of this patent is extended or adjusted under 35 U.S.C. 154(b) by 0 days.

(21) Appl. No.: 14/514,376

(22) Filed: Oct. 14, 2014

(51) Int. Cl.
*A42B 3/12* (2006.01)

(52) U.S. Cl.
CPC ..... *A42B 3/121* (2013.01)

(58) Field of Classification Search
CPC ..... A42B 3/063; A42B 3/10; A42B 3/121; A42B 3/122
USPC ..... 2/410, 411, 412, 413, 414
See application file for complete search history.

(56) References Cited

U.S. PATENT DOCUMENTS 3,039,109 A * 6/1962 Simpson ..... A42B 3/121 2/413
3,208,080 A * 9/1965 Ernest ..... A42B 3/322 2/414
3,766,669 A * 10/1973 Pearsall ..... A43D 35/00 264/321
3,787,893 A * 1/1974 Larcher ..... A42B 3/062 2/413
3,872,511 A * 3/1975 Nichols ..... A42B 3/121 2/413
4,307,471 A * 12/1981 Lovell ..... A42B 3/065 2/411
4,343,047 A * 8/1982 Lazowski ..... A42B 3/125 2/411
5,168,576 A * 12/1992 Krent ..... A41D 13/0156 2/16
5,815,846 A * 10/1998 Calonge ..... A42B 3/121 2/413
6,752,450 B2 * 6/2004 Carroll, III ..... B32B 3/28 188/371
7,254,843 B2 * 8/2007 Talluri ..... A42B 3/063 2/411
8,209,784 B2 * 7/2012 Nimmons ..... A42B 3/20 2/411
8,524,338 B2 * 9/2013 Anderson ..... A41D 13/015 428/34.1
8,613,114 B1 * 12/2013 Olivares Velasco ... A42B 3/125 2/171
8,707,470 B1 * 4/2014 Novicky ..... A42B 3/06 2/411
8,726,424 B2 * 5/2014 Thomas ..... A42B 3/124 2/414
2001/0032351 A1 * 10/2001 Nakayama ..... A42B 3/064 2/412
2005/0166302 A1 * 8/2005 Dennis ..... A42B 3/121 2/414
2005/0246824 A1 * 11/2005 Berger ..... A42B 3/124 2/412
2007/0209098 A1 * 9/2007 Peart ..... A42B 3/281 2/410
2007/0226881 A1 * 10/2007 Reinhard ..... A42B 3/065 2/412
2009/0210998 A1 * 8/2009 Rolla ..... A42B 3/14 2/411
2010/0223732 A1 * 9/2010 Allman ..... A42B 3/128 5/717
2011/0107503 A1 * 5/2011 Morgan ..... A42B 3/124 2/456
2012/0266365 A1 * 10/2012 Cohen ..... A42B 3/124 2/411
2013/0185837 A1 * 7/2013 Phipps ..... A42B 3/064 2/2.5
2013/0298316 A1 * 11/2013 Jacob ..... A42B 3/125 2/414
2014/0007322 A1 * 1/2014 Marz ..... A42B 3/065 2/411
2014/0068840 A1 * 3/2014 Nauman ..... A42B 3/128 2/411
2015/0089724 A1 * 4/2015 Berry ..... A42B 3/064 2/414
2015/0128335 A1 * 5/2015 Dehni ..... A41D 13/0512 2/459

* cited by examiner

*Primary Examiner* — Danny Worrell

(57) ABSTRACT

An apparatus (50) that dissipates a force (44). The apparatus (50) can be implemented in a wearable embodiment (31) such as a helmet (50) as well as non-wearable embodiments (32). As a helmet (50), the apparatus (30) can protect the user (40) from concussions that would otherwise result from an application of force (44) impacting the head (42) of the user (40) by dissipating the impacting force (44). A variety of components of the helmet (50) can assist in the dispersion process, including but not limited to the use of elastic structures (210) within the apparatus (30).

20 Claims, 20 Drawing Sheets

PROTECTIVE APPARATUS AND METHOD FOR DISSIPATING FORCE

BACKGROUND OF THE INVENTION

The invention relates generally to protective equipment such as helmets, guards, and padding that dissipate force (collectively, the "apparatus"). The apparatus can be implemented in helmet embodiments (the "helmet apparatus" or simply the "helmet") as well as a variety of non-helmet embodiments such as wearable padding embodiments, equipment embodiments, and structural embodiments.

The issue of concussions is a growing concern for football players at all levels of play. A Google search on the terms "concussion" and "football" generates more than 6.5 million hits. Concerned parents are increasingly reluctant to let their kids play football. On the other end of the continuum, the National Football League ("NFL") was sued for $2.5 B for allegedly hiding known risks pertaining to concussions and other brain-related injuries. From local pewee football leagues to the economic juggernaut of the NFL, the objective of protecting the heads and brains of the players is a prominent and growing concern.

One fundamental problem with football helmets is that they address the wrong problem. Modern football helmets are designed to prevent skull fractures, not concussions. Thus, there is very little "give" in a modern football helmet. As a result, modern football helmet can actually make it more likely that a player suffers a concussion. This is particularly true when the opposing players use their own helmet as the tip of the spear in a violent hit.

The modern football helmet grew out of the military equipment of World War II. The first plastic helmet was experimented with in 1939. According to the http://www.riddell.com website, General Patton saw the new football helmet design and requested examples of it to evaluate as a possible tanker's helmet.

The tradeoffs between preventing skull fractures and preventing concussions can exist outside the context of football and military helmets. Sports such as hockey, polo, horseback riding, lacrosse, baseball, cricket, cycling, climbing, bobsledding, fencing, and amateur boxing often utilize helmets. Helmets are also often used in the working world by firemen, construction workers, miners, police officers, and other occupations.

Analogous tradeoffs can often be found in the context of non-helmet embodiments such as: (1) other articles of clothing (collectively, "wearable padding embodiments"); (2) industrial, exercise, and other types of equipment (collectively, "equipment embodiments"); and (3) permanent surfaces such as floors, walls, athletic fields, and playground surfaces (collectively, "surface embodiments").

There are many contexts where force dissipation is desirable. It would be desirable for a helmet as well as other protective apparatuses to be designed to better dissipate the force applied to the external surface of the apparatus. In the context of a helmet, such functionality could help wearers avoid concussions. In the context of non-helmet embodiments, such as other wearable embodiments, human beings can be better protected from non-head injuries. In the context of non-wearable embodiments, people as well as property can be protected by equipment embodiments and surface embodiments.

SUMMARY OF THE INVENTION

The invention relates generally to protective equipment such as helmets, guards, and padding that dissipate force (collectively, the "apparatus"). The apparatus can be implemented in helmet embodiments (the "helmet apparatus" or simply the "helmet") as well as a variety of non-helmet embodiments such as wearable padding embodiments, equipment embodiments, and structural embodiments.

The apparatus can be implemented in a wide variety of different designs and configurations utilizing a wide variety of component materials, geometries, and dimensions. The apparatus can possess enhanced dissipation, elasticity, and recovery attributes and utilize such attributes for the protection of human beings, property, other animals, and other purposes.

The apparatus can utilize a layer of elastic structures to dissipate the impact of a force hitting the apparatus.

BRIEF DESCRIPTION OF THE DRAWINGS

Many features and inventive aspects of the helmet are disclosed in the Figures described briefly below. However, no patent application can disclose all of the potential embodiments of an invention. In accordance with the provisions of the patent statutes, the principles and modes of operation of the helmet are explained and illustrated with respect to certain preferred embodiments. However, it must be understood that the structures and methods described above may be practiced otherwise than is specifically explained and illustrated without departing from its spirit or scope. Each of the various elements described in the index/glossary below can be implemented in a variety of different ways while still being part of the spirit and scope of the invention. For example, additional surfaces and layers can be added to the helmet, elastic structures of a wide variety of different geometric shapes can be used, various components can be comprised of a wide variety of different materials, etc.

All of the component element numbers used in the Figures discussed below are listed and described in the index/glossary of element numbers provided in Table 2 below.

FIG. 2*l* is a block diagram illustrating an example of different component and component categories that can be incorporated into the helmet.

FIG. 5*b* is diagram illustrating a variety of different geometric shapes that the elastic structures can be shaped as.

DETAILED DESCRIPTION

The invention relates generally to protective equipment such as helmets, guards, and padding that dissipate force (collectively, the "apparatus"). The apparatus can be implemented in helmet embodiments (the "helmet apparatus" or simply the "helmet") as well as a variety of non-helmet embodiments such as wearable padding embodiments, equipment embodiments, and structural embodiments.

The protective apparatus can dissipate the impact of a potentially damaging force. The elastic nature of at least some of the components of the apparatus provides the ability to dissipate a potentially damaging blow while quickly recovering so that future blows may be similarly dissipated.

I. Overview

Figure 1A:
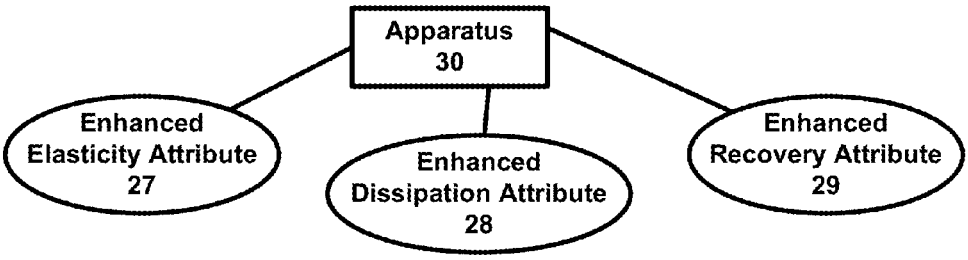
FIG. 1*a* is a block diagram illustrating examples of enhanced attributes that can be implemented in various embodiments of the apparatus.

As illustrated in FIG. 1*a*, the apparatus 30 that can possess an enhanced elasticity attribute 27, an enhanced dissipation attribute 28, and/or an enhanced recovery attribute 29. These enhancements are relative the prior art. The apparatus 30 is intended to provide more "give" than comparable protection applications in the prior art. The enhanced elasticity attribute 27 or "give" of the apparatus 30 can allow the apparatus 30 to more effectively dissipate the impact of a force striking the apparatus 30. If the apparatus 30 is to be effective against more than a single impact, the apparatus 30 can benefit from an enhanced recovery attribute 29 allowing the apparatus 30 to quickly recover from a first impact so that the apparatus 30 can dissipate future impacts.

Figure 1B:
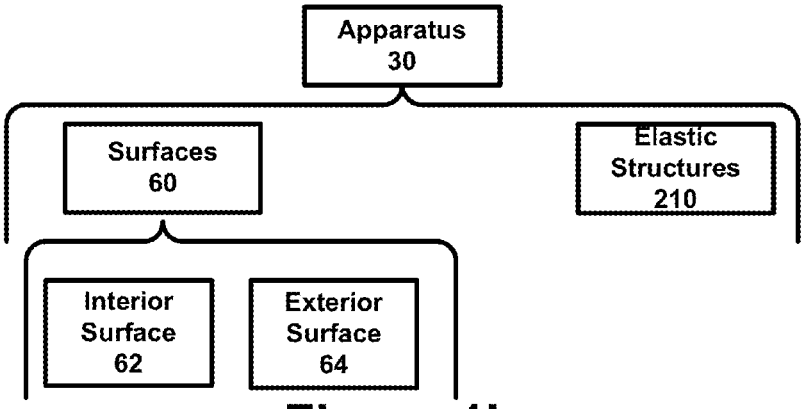
FIG. 1*b* is a component diagram illustrating an example of different components that can comprise the apparatus.

As illustrated in FIG. 1*b*, the apparatus 30 can be implemented as a set of elastic structures 210 positioned between an interior surface 62 of the apparatus 30 and an exterior surface 64 of the apparatus 30. The elastic component of the apparatus 30 can quickly recover to its original shape, quickly enabling the apparatus 30 to dissipate subsequent impacts after a short recovery time. The apparatus 30 can be particularly useful in protecting living beings from the impact of a force, such as blunt force trauma. The apparatus 30 was originally conceived as a vastly improved form of football helmet that could reduce the frequency, magnitude, and negative ramifications of concussions and other forms of brain injuries. In contrast to rigid (i.e. non-elastic) prior art football helmets, the concepts underlying the function and structure of the apparatus 30 are to utilize elasticity to dissipate the force of an impact, and to utilize a relatively quick recovery time for the elasticity to rebound to its original state so that the apparatus 30 can subsequently dissipate future impacts mere microseconds into the future.

A. Alternative Embodiments of the Apparatus

The apparatus 30 can be implemented in a wide variety of different ways utilizing different components that are comprised of different materials and organized in different configurations. In accordance with the provisions of the patent statutes, the principles and modes of operation of this apparatus 30 have been explained and illustrated in a variety of embodiments and configurations. However, it must be understood that this apparatus 30 may be practiced otherwise than is specifically explained and illustrated without departing from its spirit or scope. The apparatus 30 and methods for using and making the apparatus 30 can be implemented in a wide variety of different components, component configurations, and component compositions.

Figure 1C:
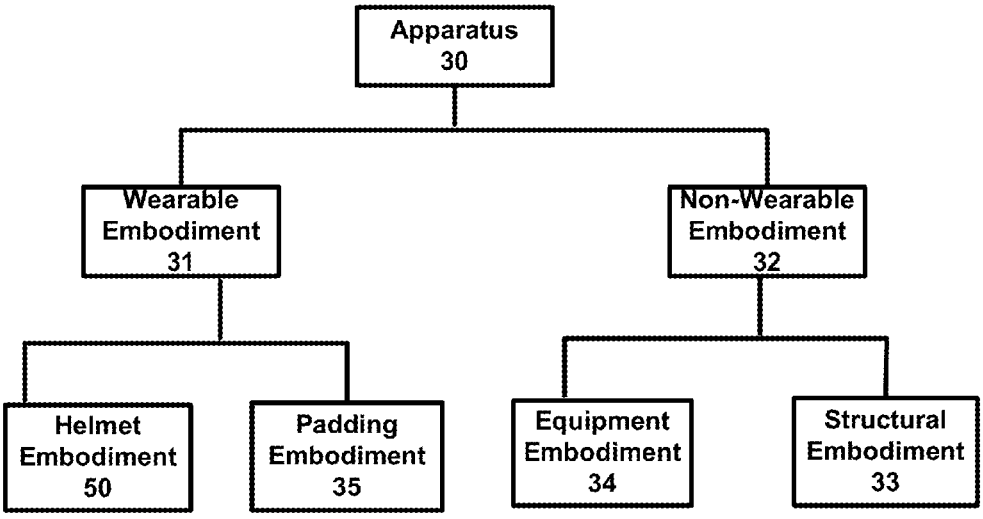
FIG. 1*c* is a hierarchy diagram illustrating an example of different embodiments of the apparatus.

Although originally inspired as an improvement to prior art football helmets, the apparatus 30 is not limited helmets, much less football helmets. FIG. 1*c* is a hierarchy diagram illustrating categories and subcategories of different embodiments of the apparatus 30.

1. Wearable Embodiments of the Apparatus

Examples of wearable embodiments 31 of the apparatus 50 can include: (1) a wide variety of helmet apparatuses 50 which can pertain to various types of sports, occupations, medical conditions, and potentially dangerous activities; and (2) a wide variety of padding apparatuses 35 that are worn on the body of the user but are not worn on the head of the user.

2. Non-Wearable Embodiments of the Apparatus

Examples of non-wearable embodiments 32 can include: (1) an equipment apparatus 34 that one might utilize on gym equipment, industrial tools, or other machines; and (2) a structural apparatus 33 that one might find useful in the context of playing field, playground floor, gym wall, or some similar context.

B. Helmets

The original inspiration for the conception of the apparatus 30 was the growing public concern about brain injuries in the context of the game of football. However, as illustrated in FIG. 1*k*, there are a wide variety of different embodiments of the apparatus 30 that can be implemented in the form of a helmet 50. Examples of helmets 50 embodying the apparatus 30 can include but are not limited to football helmets, miner helmets, construction helmets, bicycle helmets, motorcycle helmets, fireman helmets, military helmets, and baseball helmets. Although the apparatus 30 can be implemented om a wide variety of different ways, including many different types of helmets 50, it is anticipated that football helmet 50 embodiments of the apparatus 30 will be highly beneficial and well received by players, coaches, trainers, and fans alike.

Figure 1D:
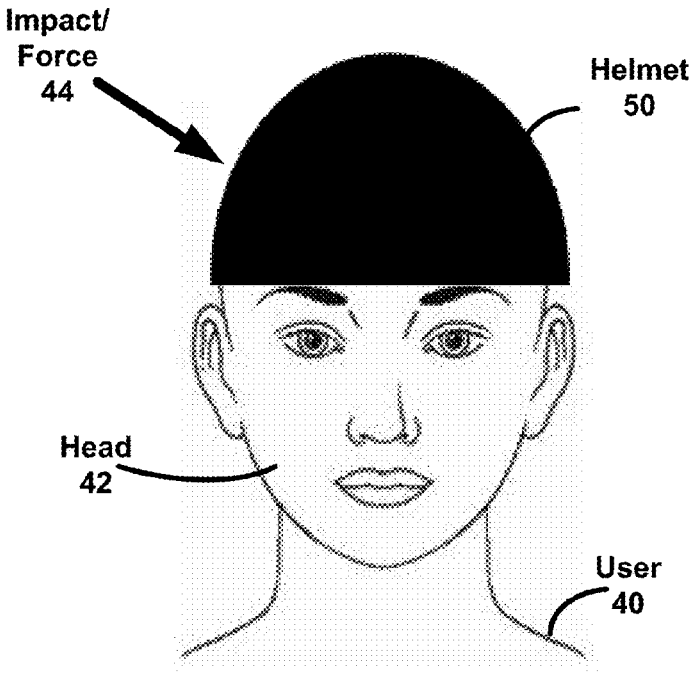
FIG. 1*d* is an environmental diagram illustrating an example of a human being wearing a helmet embodiment of the apparatus. The helmet is positioned between an external force and the head of the wearer.
Figure 1E:
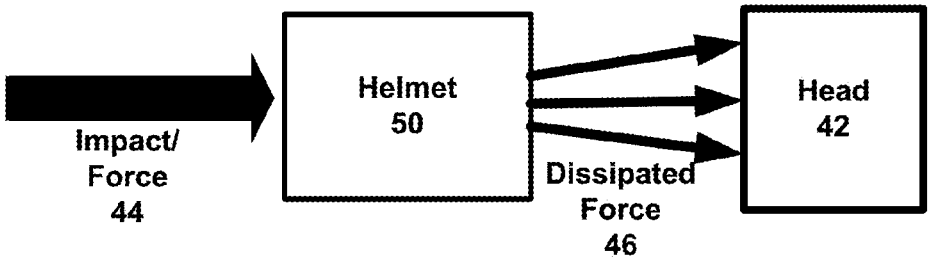
FIG. 1*e* is an input/output diagram illustrating an example of a helmet dissipating the impact of the force hitting the helmet.
Figure 1F:
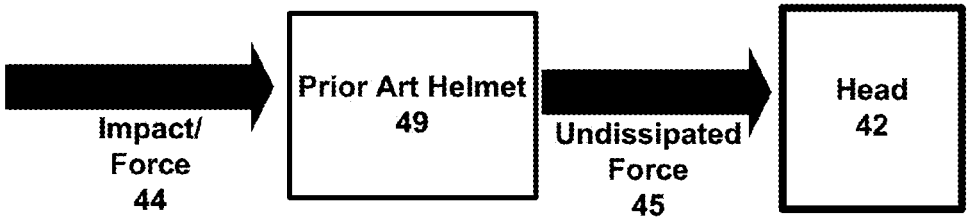
Prior Art Figure 1f
FIG. 1*f* is a prior art diagram illustrating an example of a prior art helmet transmitting undissipated force to the wearer of the prior art helmet.

As illustrated in FIG. 1*d*, helmets 50 are worn on a head 42 of a user 40, who is typically a human being. The helmet 50 serves to protect the head 42 of the user 40 from a force 44 that would otherwise directly strike the head 32 of the user 40. As illustrated in FIG. 1*e*, the helmet 50 embodiment of the inventive apparatus 30 propagates a dissipated force 46 to the head 42 of the user 40. In contrast, and as illustrated in FIG. 1*f*, a prior art football helmet 49 propagates an undissipated force 45 to the head 42 of the user 40.

Brain injuries are a growing concern to football players at all levels of the game, spanning the entire continuum of football from the elite professional games of the NFL, the college games of the NCAA, the high school games that have a tremendous impact on the social life of high school students and local communities throughout the United States, and the junior leagues of pre-teens and young children.

The prior art helmet 49 that is the modern football helmet grew out of the military equipment of World War II. The first plastic helmet was experimented with in 1939. According to the http://www.riddell.com website, General Patton saw the new football helmet design and requested examples of it to evaluate as a possible tanker's helmet.

Modern football helmets are designed to prevent skull fractures, not concussions. Such helmets are highly rigid, with very little "give". As a result, modern football helmets can actually make it more likely that a player suffers a concussion. This is particularly true when players use their own helmets as the tip of the spear in a violent hit.

The apparatus 30 is not limited to helmets 50, but it is believed that helmets 50 will be a particularly useful category of embodiment of the apparatus 30.

The football helmet 50 embodiment of the apparatus 30 can provide substantially superior protection to the head 42 of the user 40 compared to what is provided by conventional football helmets 49 or other prior art technologies. These advantages have been confirmed by experimental data.

The enhanced dissipation attribute 28 of the apparatus 30 as discussed above and as illustrated in FIGS. 1*a*, 1*e*, and 1*f* have been confirmed through repeated experimentation. The enhanced attributes of the of the innovative helmet 50 relative to the conventional football helmet 49 of the prior art have been proven in the test results illustrated in FIGS. 1*g*, 1*h*, 1*i*, and 1*j*. Table 1 below summarizes actual test results comparing the innovative helmet 50 in contrast to the conventional prior art football helmet 49.

TABLE 1

| Helmet Type | Test Type | Max G Force | Duration | Figure |
|---|---|---|---|---|
| Innovative 50 | Swing | 7 | 4 ms | 1g |
| Prior Art 49 | Swing | 43 | 14 ms | 1h |
| Innovative 50 | Drop | 29 | 7 ms | 1i |
| Prior Art 49 | Drop | 70 | 10 ms | 1j |

A description of the swing test and the drop test are provided below in a section titled "VII. TEST RESULTS—OBJECTIVE MEASURE OF INNOVATION".

C. Advantages of the Apparatus

As discussed above with respect to FIG. 1*a*, the apparatus 50 has important advantages over the prior art. The helmet 50 embodiments of the apparatus 30 can have important advantages over the conventional football helmet and other prior art helmets 49. These advantages can be achieved in helmet 50 embodiments of the apparatus 30 as well as other embodiments of the apparatus 30.

1. Elasticity/Flexibility

There is very little "give" in a conventional football helmet 49. Prior art football helmets 49 are intentionally designed to be highly rigid. In contrast, the innovative helmet 50 embodies the opposite approach. The helmet 50, or at least portions of the helmet 50, are intentionally designed to be highly elastic. When something is elastic, it is flexible, resilient, and adaptable. In other words, an elastic material has "give" that is missing from a conventional football helmet and other forms of prior art helmets. The helmet 50 uses a layer of elastic structures to enhance the overall elasticity of the helmet 50. The elasticity of the helmet 50 enhances the ability of the helmet 50 to dissipate the force 44 striking the helmet 50.

2. Dissipation/Dispersion

A conventional football helmet does little to prevent concussions because a conventional football helmet does not dissipate the force 44 striking the helmet. To the contrary, the rigidity of a conventional football helmet 49 may have the opposite effect, and enhance the focus of the force 44 striking the head 42 of the user 40.

The innovative helmet 50 serves to dissipate the impact of the force 44 striking the helmet 50 worn by the user 40. The elastic structures 210 in the helmet 50 can serve as cascading shock absorbers, designed to absorb, dissipate, and disperse the impact of the force 44 striking the helmet 50.

3. Recovery Time

To the extent that the prior art has attempted to address the limitations and failings of conventional football helmets 49, such efforts are hampered by unacceptably long recovery times. Five seconds of play on the football field can result in multiple hits from multiple players. The act of being tackled by one or more players and being brought forcefully to the ground can result in multiple blows to the head within the microseconds of each other.

The helmet 50 can be implemented in such a way such that the elasticity of the helmet 50 (along with its force dissipating qualities) can quickly recover in time to absorb the next hit. A subsequent impact 44 is something that can occur mere microseconds after the then current hit. Prior art attempts to address the issue of elasticity appear to typically involve long recovery times make such solutions impractical and unsuitable for use. In some prior art teachings, there is simply no recovery of any kind.

II. Helmet Configurations

As illustrated in FIG. 1*b* and discussed above, the most generic or broadly applicable configuration of the apparatus 30 will involve a variety of elastic structures 210 to provide the elasticity 27, dissipation 28, and recovery 29 attributes that are discussed above. Helmet 50 embodiments of the apparatus 30 can include these components in a configuration that will from the outside appear very much like a conventional prior art helmet 49.

The different components that may be utilized in the configurations discussed below in section "II. Helmet Configurations", section "III. Surfaces and Layers", and section "IV. Detailed Description of Components".

A. Helmet Configuration #1

Figure 2A:
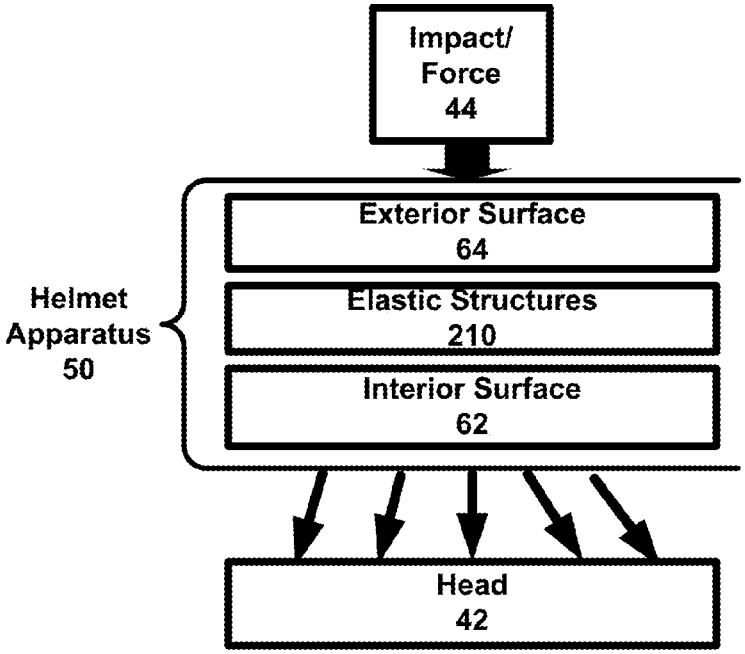
FIG. 2*a* is a block diagram illustrating an example of a helmet comprised of elastic structures and of various surfaces, such as an interior surface and an exterior surface.

FIG. 2*a* provides an illustration that is similar to FIG. 1*b* except that FIG. 2*a* is specific to helmets 50 while FIG. 1*b* is more generally applicable to different categories of embodiments of the apparatus 30. Elastic structures 210 are positioned between the exterior surface 64 and interior surface 62 of the helmet 50.

B. Helmet Configuration #2

Figure 2B:
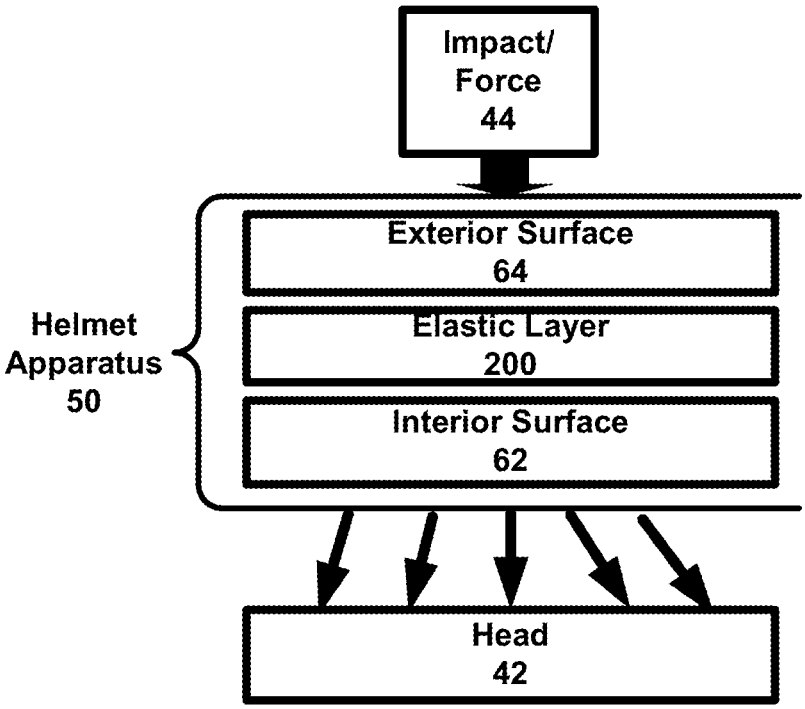
FIG. 2*b* is a block diagram illustrating an example of a helmet embodied in a configuration of a layer of elastic structures positioned between an exterior surface and an interior surface.

FIG. 2*b* provides an illustration that is similar to FIG. 2*a* except that the elastic structures 210 are organized into an elastic layer 200 that is contained within the space between the exterior surface 64 and the interior surface 62.

C. Helmet Configuration #3

Figure 2C:
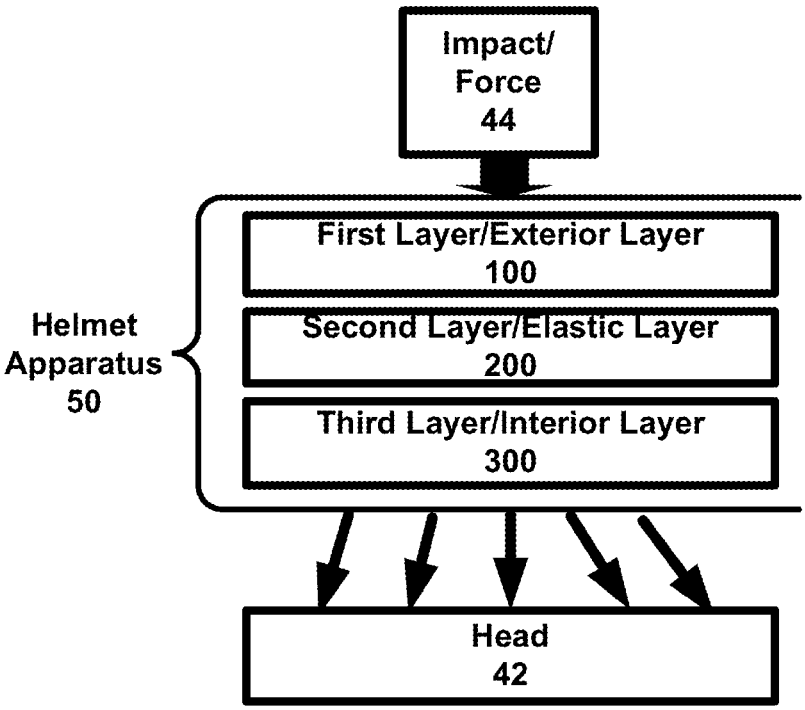
FIG. 2*c* is a block diagram illustrating an example of the helmet embodied in a three layered configuration.

FIG. 2*c* provides an illustration that is similar to FIG. 2*b* except that the elastic layer 200 is positioned between an exterior layer 100 and an interior layer 300. All three layers are described in detail below in section "III. Helmet Components".

D. Helmet Configuration #4

Figure 2D:
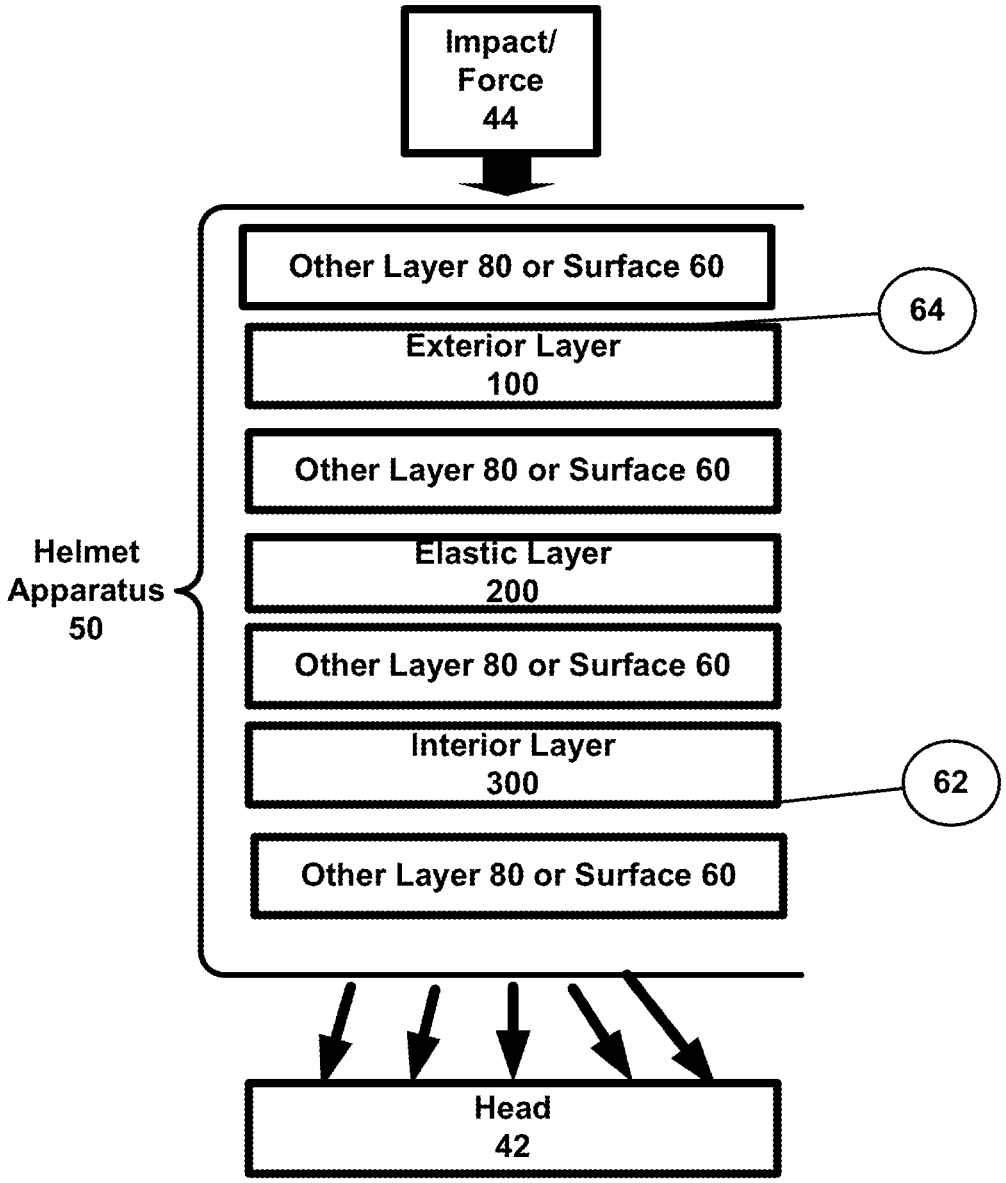
FIG. 2*d* is a block diagram illustrating an example of the helmet illustrated in FIG. 2*c* that includes additional layers.

FIG. 2*d* provides an illustration that is similar to FIG. 2*c* except that there are additional layers 80 and/or surfaces 60 positioned to the exterior of the exterior layer 100, in between the exterior layer 100 and the elastic layer 200, in between the elastic layer 200 and the interior layer 300, and to the interior of the interior layer 300. In other words, the helmet 50 and other embodiments of the apparatus 30 can include additional layers, surfaces, structures, etc. while still functioning at the helmet 50 or other embodiment of the apparatus 30.

As illustrated in FIG. 2*d*, layers 80, surfaces 60, and other structures can be positioned to the exterior of the exterior surface 64 and to the interior of the interior surface 62 as the references to exterior surface 64 and interior surface 62 are relative to each other and the other key components. This nomenclature is used and supported so that the apparatus 30 or helmet 50 does not cease being the apparatus 30 or helmet 50 merely because something was added to the apparatus 30 or helmet 50.

E. Helmet Configuration #5

Figure 2E:
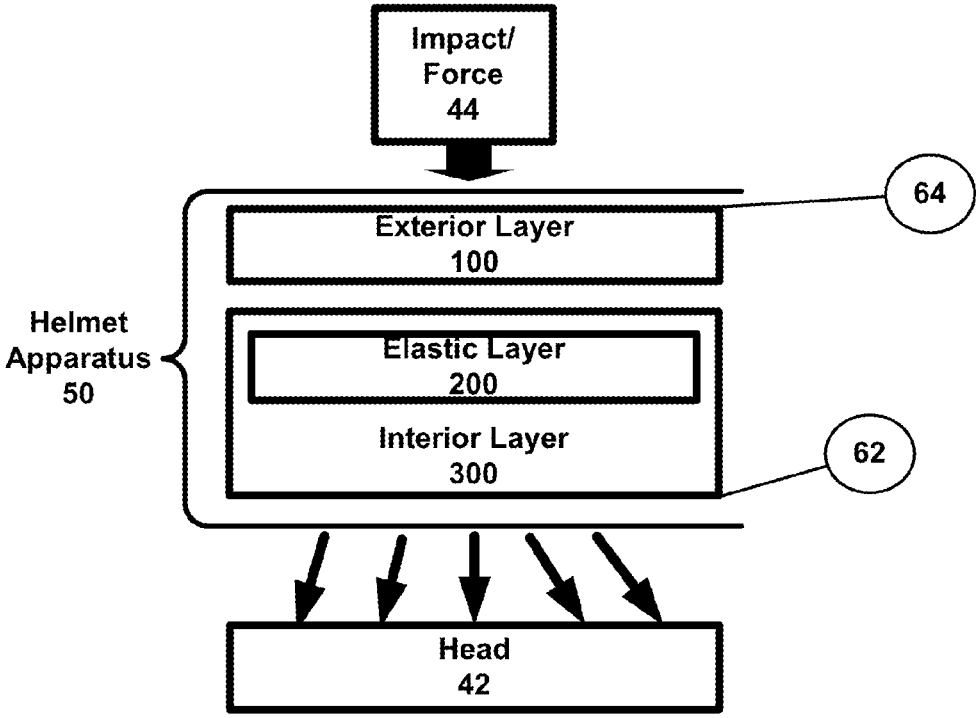
FIG. 2*e* is a block diagram illustrating an example of a three layer helmet embodiment with an elastic layer embedded within the interior layer.

FIG. 2*e* provides an illustration that is similar to FIG. 2*c* except that the elastic layer 200 is embedded within the interior layer 300.

F. Helmet Configuration #6

Figure 2F:
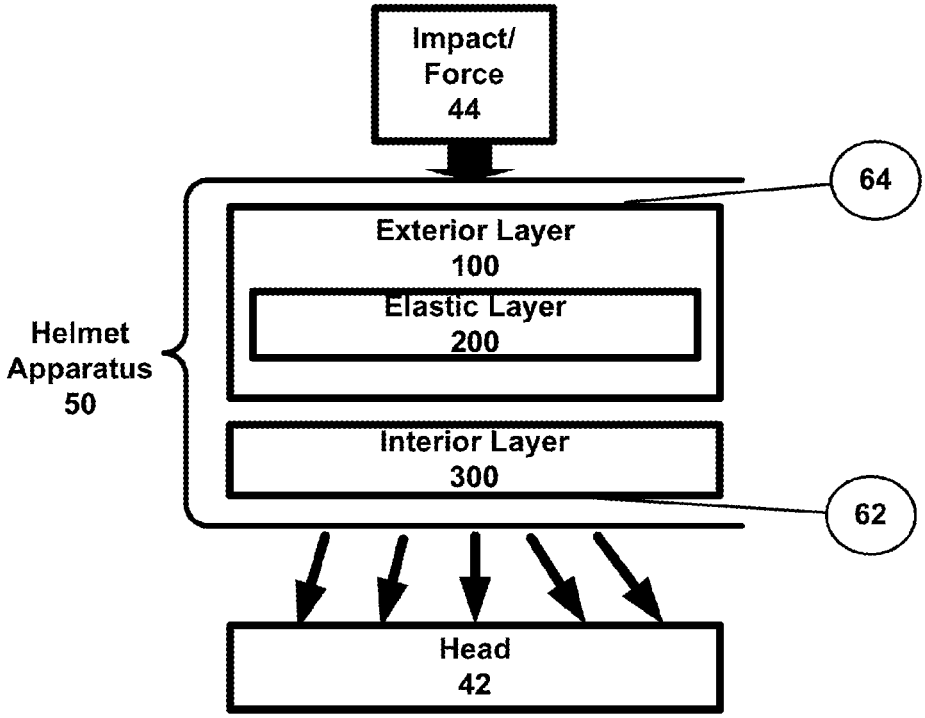
FIG. 2*f* is a block diagram illustrating an example of a three layer helmet embodiment with an elastic layer embedded within the exterior layer.

FIG. 2*f* provides an illustration that is similar to FIG. 2*c* except that the elastic layer 200 is embedded within the exterior layer 100.

G. Helmet Configuration #7

Figure 2G:
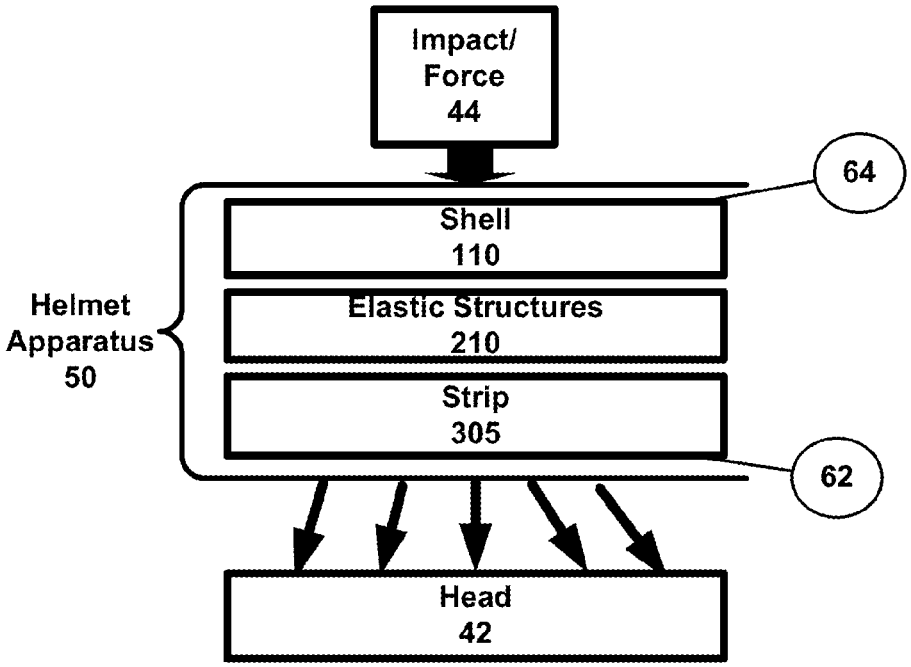
FIG. 2*g* is a block diagram illustrating an example of a helmet comprised of elastic structures positioned between an external shell and an internal strip.

FIG. 2*g* illustrates an example of a helmet 50 that is comprised of elastic structures 210 positioned between a shell 310 and a strip 305. The exterior surface 64 of the helmet 50 is the exterior surface of the shell 310 and the interior surface 62 of the helmet 50 is the interior surface of the strip 305.

H. Helmet Configuration #8

Figure 2H:
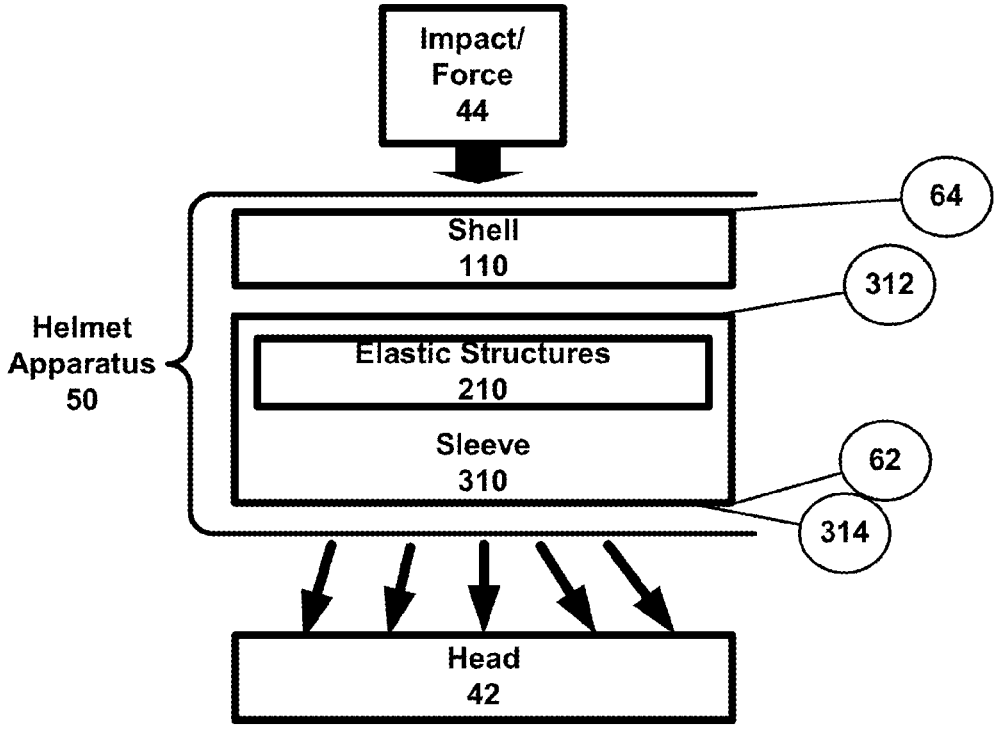
FIG. 2*h* is a block diagram illustrating an example of a helmet comprised of elastic structures positioned within one or more sleeves that are interior relative to the external shell.

FIG. 2*h* illustrates an example of a helmet 50 that is comprised of elastic structures 210 positioned within a sleeve 310 that is located to the interior of the shell 110. The exterior surface 64 of the helmet 50 is the exterior surface of the shell 110. The interior surface 62 of the helmet is a bottom sleeve surface 314. A top sleeve surface 312 is positioned to the interior of the shell 110. The top sleeve surface 312 can be attached to the interior surface of the shell 110 in a wide variety of different ways.

III. Surfaces and Layers

The helmet 50 and other embodiments of the apparatus 30 can be comprised of a variety of different components comprised of a wide variety of different materials and implemented in a wide variety of different shapes. Many of the components of the apparatus 30 can be characterized as either a layer 80 or a surface 60.

Figure 2I:
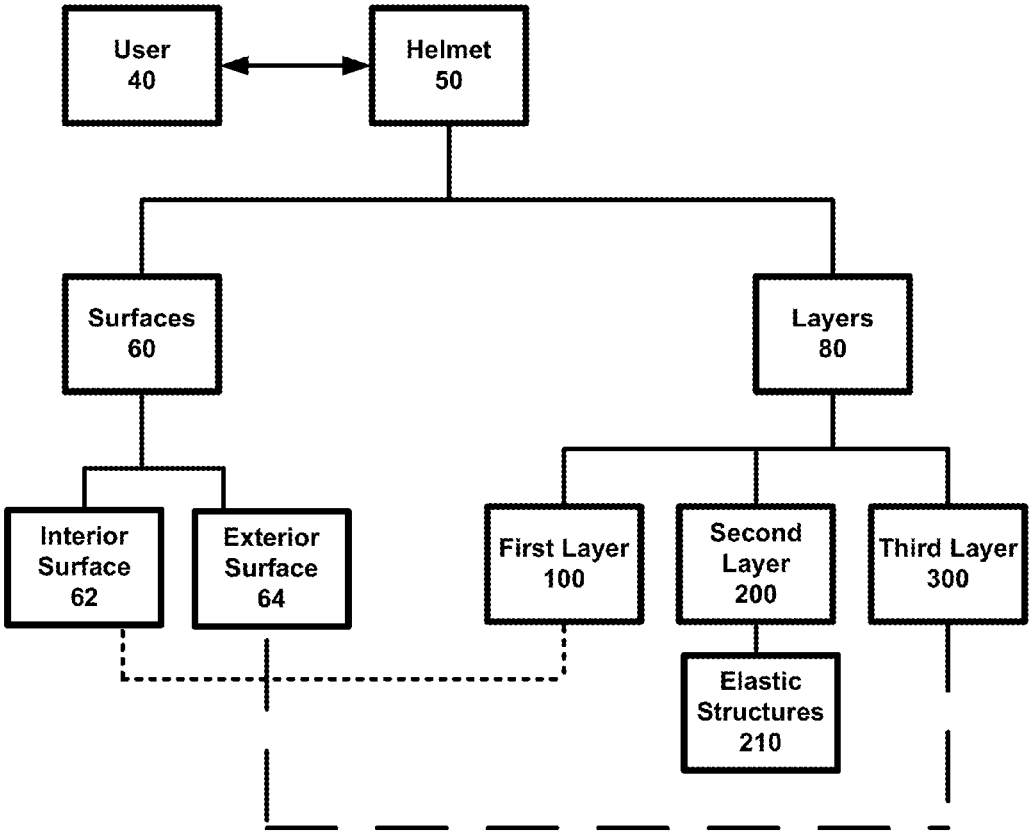
FIG. 2*i* is a block diagram illustrating an example of different component and component categories that can be incorporated into the helmet.
Figure 2J:
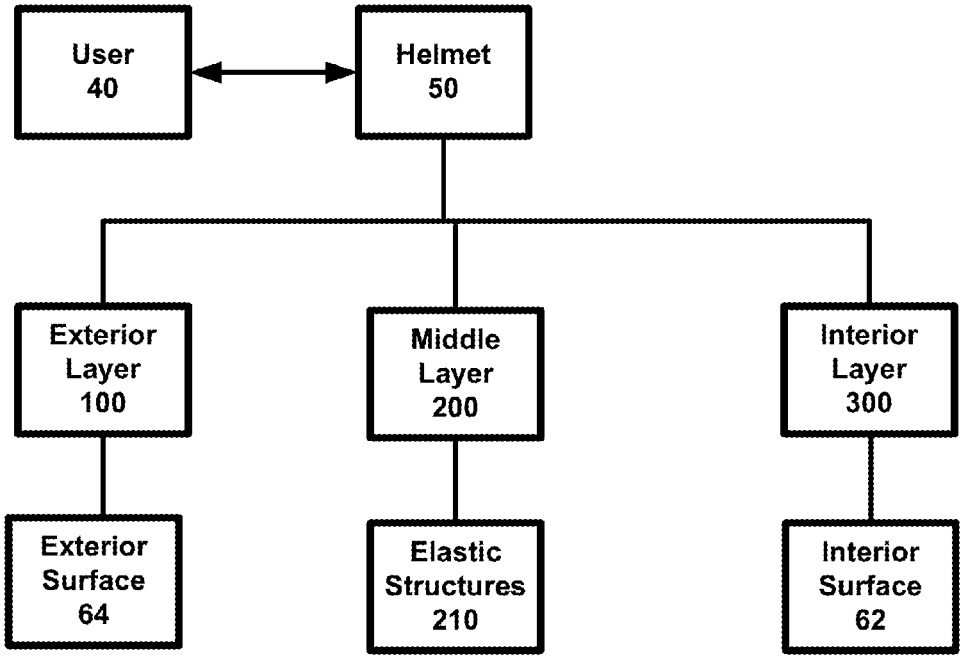
FIG. 2*j* is a block diagram illustrating an example of different component and component categories that can be incorporated into the helmet.
Figure 2K:
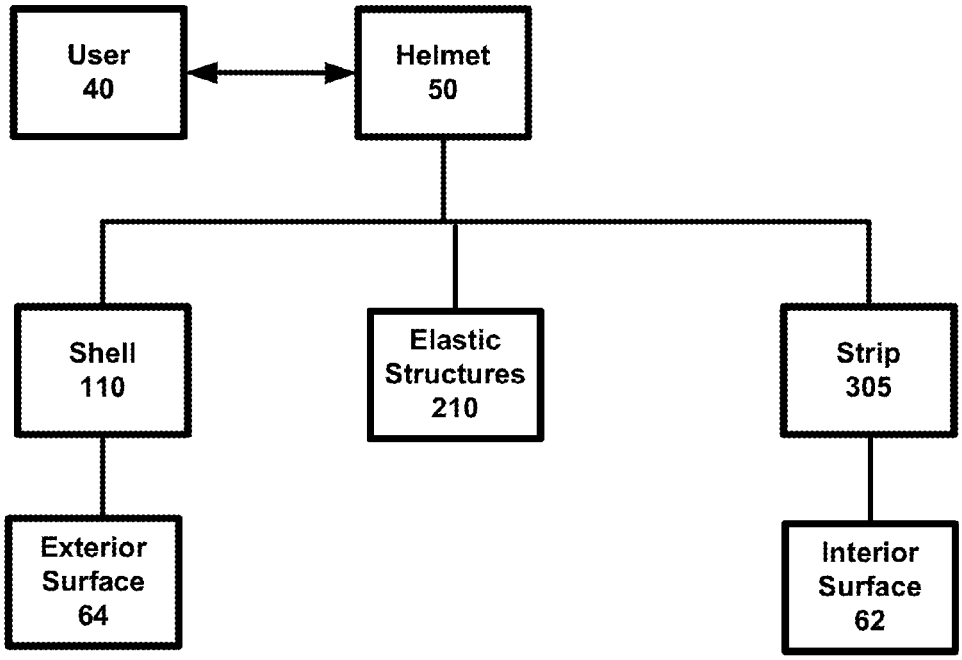
FIG. 2*k* is a block diagram illustrating an example of different component and component categories that can be incorporated into the helmet.
Figure 2I:
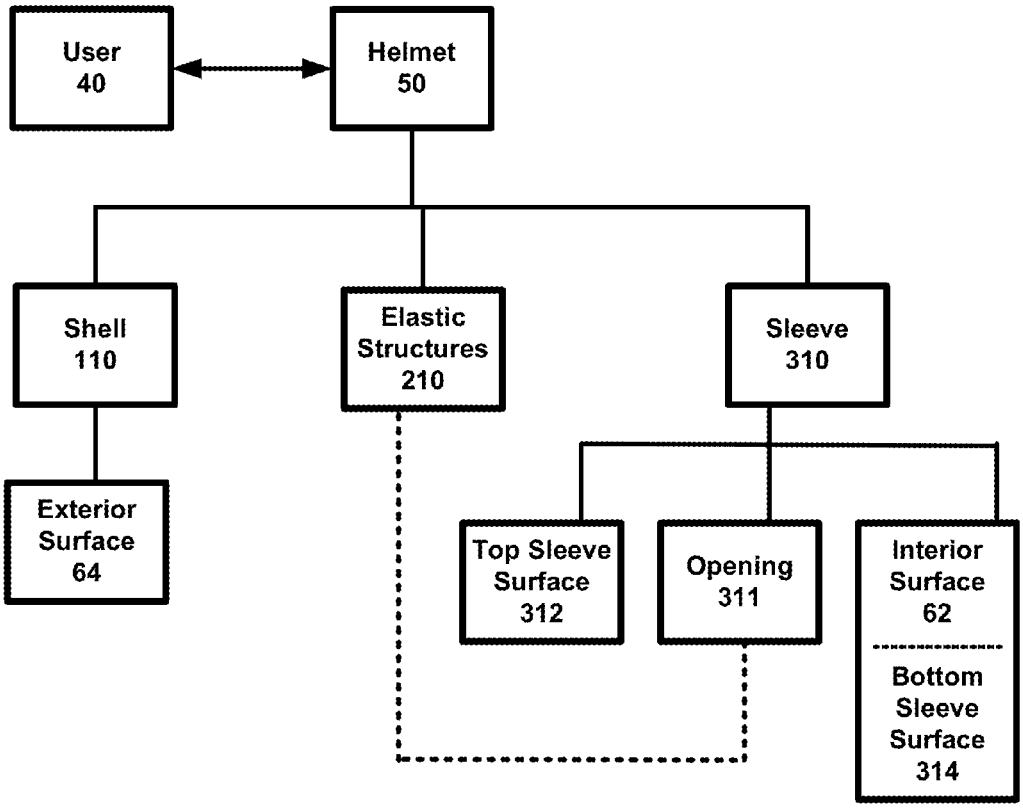

FIG. 2*i* is a block diagram illustrating an example of different component and component categories that can be incorporated into the helmet 50. The helmet 50 can possess an interior surface 62 and an exterior surface 64. Many embodiments of the apparatus 30 can include an elastic layer 200 (i.e. middle layer 200) sandwiched between an exterior layer 100 (i.e. first layer 100) and an interior layer 300 (i.e. a third payer 300).

A. Surfaces

A surface 60 is a face or boundary. Examples of surfaces 60 include an interior surface 62 of the helmet and an external surface 64 of the helmet 50.

1. Interior Surface

A surface of the helmet 50 that is closest to the head 42 of the user 40 relative to the other components of the helmet 50 described in this glossary/index. The interior surface 62 can be comprised of a wide variety of different materials in a wide variety of different geometric shapes. For example, the interior surface 62 can be comprised of plastic, rubber, nylon, cloth, and other substances. Different interior surfaces 62 can have different characteristics in terms of gas permeability and liquid permeability. For example, the interior surface 62 can be comprised of a cloth material that provides for the carrying away of moisture from the user 40. The interior surface 62 is typically either one or more strips 305, or one or more sleeve bottom surfaces 314. As indicated in FIGS. 2*i*, 2*j*, 2*k*, and 2*l*, the interior surface 62 of the apparatus 30 as a whole is typically the bottom surface of a sleeve 310 or strip 305 that forms the interior constraint for the position of the elastic structures 210. The shell 110, exterior surface 64, or other manifestation of an exterior layer 100 comprises the other half of the constraint on the position and motion of the elastic structures 210.

2. Exterior Surface

A surface of the helmet 50 that is further away from the head 42 of the user 40 relative to the other components of the helmet 50. It is the exterior surface 64 that provides for receiving the impact of force 44 from the outside world that can then be dispersed for the safety of the user 40. The exterior surface 64 can be comprised of a wide variety of different materials, including rigid materials, semi-elastic materials, substantially elastic materials, or even fully elastic materials. The exterior surface 64 can be non-homogeneous, semi-homogeneous, substantially homogeneous, or fully homogeneous. The exterior surface 64 can be fully continuous, substantially continuous, or merely semi-continuous in terms of possessing gaps in the surface. Different levels of liquid and gas permeability can be incorporated into the exterior surface. As illustrated in FIGS. 2*i*, 2*j*, 2*k*, and 2*l*, the exterior surface 64 of the apparatus 30 as a whole is typically the outer surface of the shell 110 or other manifestation of the exterior shell 100.

3. Other Surfaces

Every layer 80 or other component of the helmet 50 can possess a variety of surfaces 60. For example, as illustrated in FIG. 2*l*, the sleeves 310 that can make up the interior surface 62 and interior layer 100 of the apparatus 100 can possess both a top sleeve surface 312 (typically positioned to the immediate interior of the exterior layer 100 or shell 110) and a bottom sleeve surface 314 which serves as the interior surface 62 for the apparatus 30 as a whole.

B. Layers

The apparatus 30 can be described in terms of layers 80.

1. Elastic Layer/Middle Layer

Figure 3A:
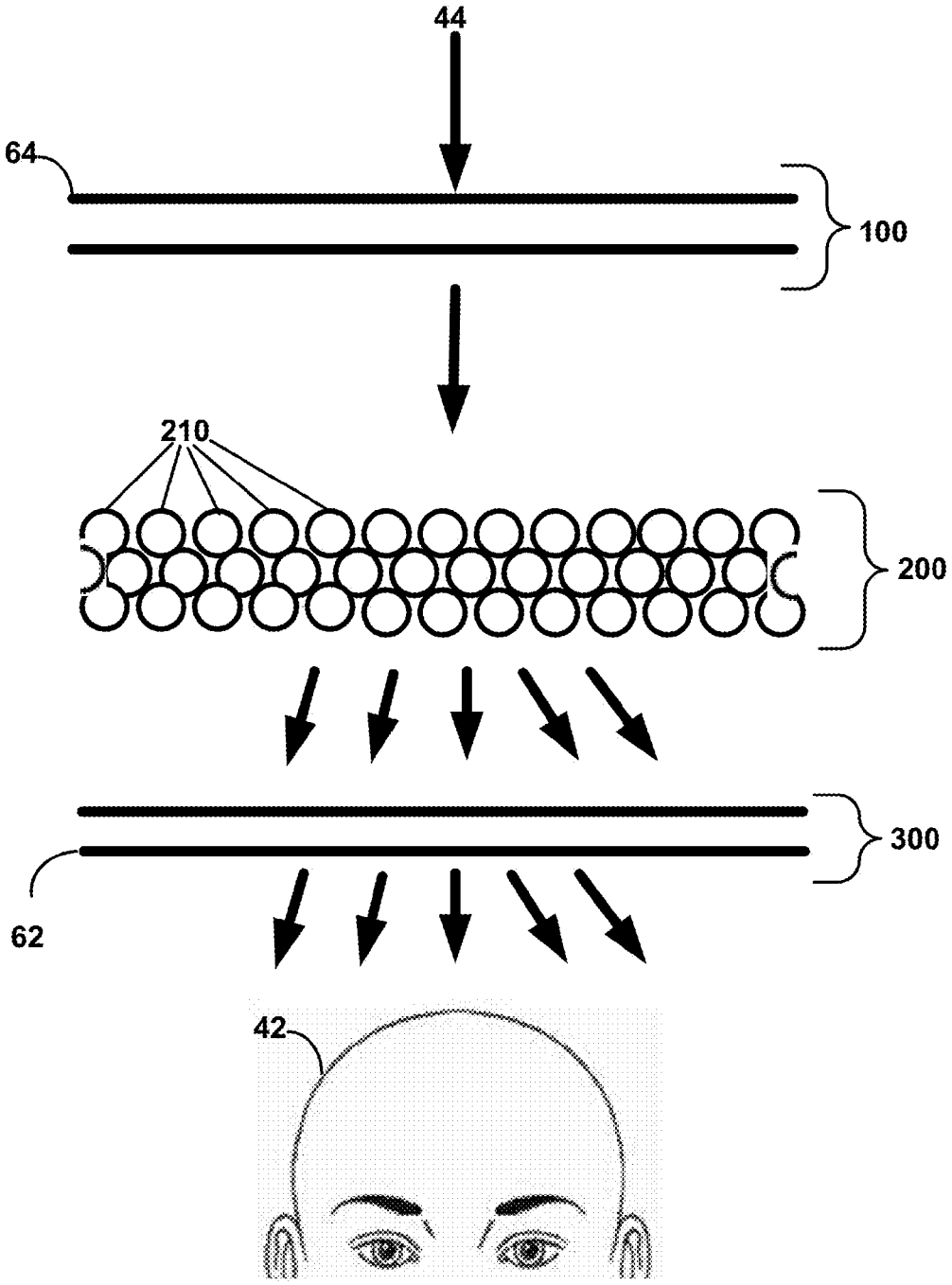
FIG. 3*a* is a process flow diagram illustrating an example of a force being transmitted through the components of the apparatus to the wearer of the helmet where the layer of elastic structures is positioned between an internal layer and an external layer.
Figure 3B:
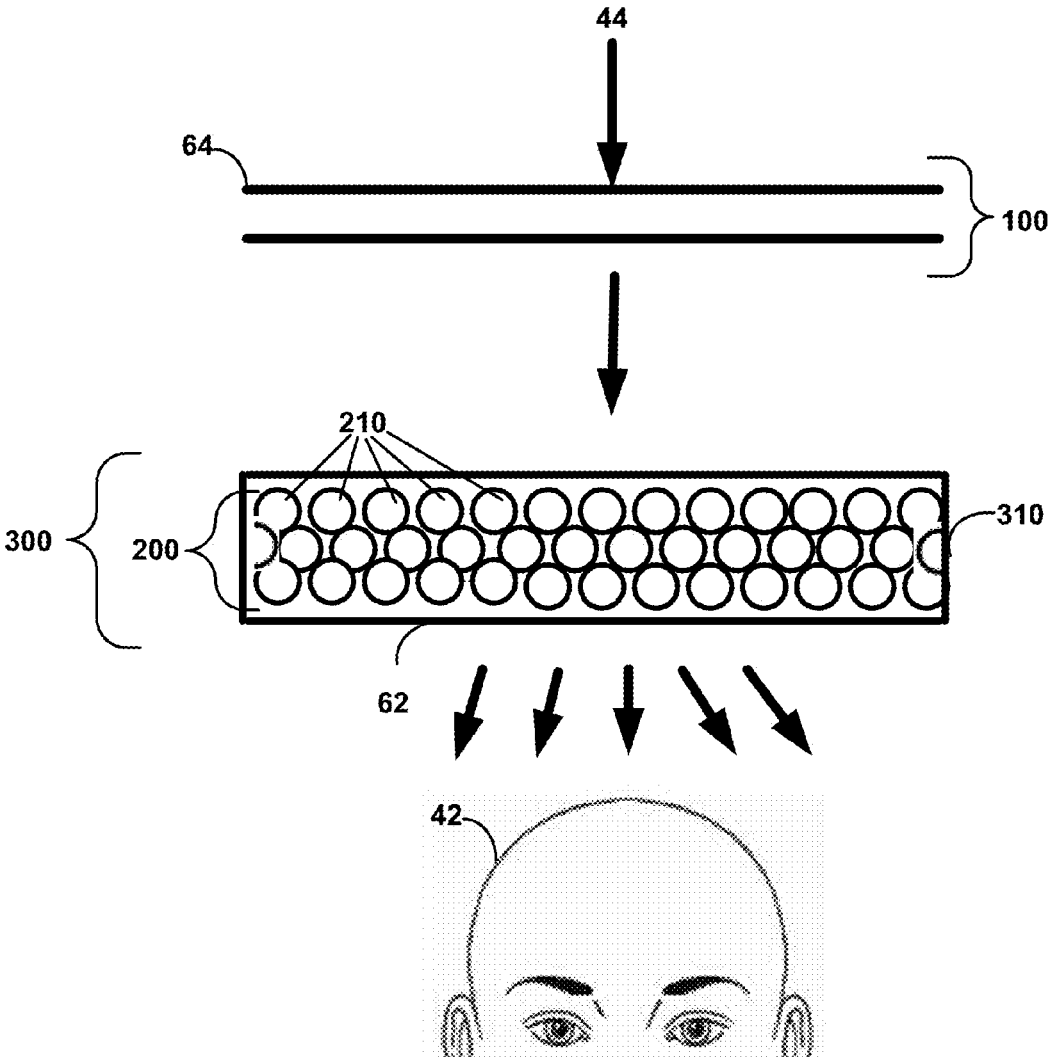
FIG. 3*b* is a process flow diagram illustrating an example of a force being transmitted through the components of the apparatus to the wearer of the helmet where the layer of elastic structures is positioned within the enclosure of a sleeve.

As illustrated in FIGS. 3*a* and 3*b*, a layer 80 of elastic structures 210, the elastic layer 200, provides the primary mechanism by which the apparatus 30 can dissipate the force 44 striking the apparatus 30. In a preferred embodiment of the apparatus 30, the elastic layer 200 is comprised of hollow elastic structures 230 that have holes 232 in them to permit the passage of air 234 out of the hollow elastic structures 230. In a preferred embodiment, the elastic structures 210 are at least substantially spherical in shape, comprised of an elastic plastic, and hollow. The hollow elastic structures 232 compress as a result of the impact 44. Air 234 passes out of the hollow elastic structures 230, dissipating the force 44 striking the apparatus 30. The hollow elastic structures 230 can then quickly re-inflate in mere milliseconds to dissipate subsequent additional impacts 44.

FIG. 3*a* illustrates an example of an elastic layer 200 positioned between an exterior layer 100 and an interior layer 300. FIG. 3*a* is a more detailed illustration of FIG. 2*c*. FIG. 3*b* illustrates an example of an elastic layer 300 positioned within an interior layer 300 such as one or more hollow sleeves 310. FIG. 3*b* is a more detailed illustration of FIG. 2*e*.

2. Exterior Layer

As illustrated in FIGS. 3*a* and 3*b*, the exterior layer 100 is exterior to the elastic layer 200 and to the interior layer 300, and thus the exterior layer 100 is closer to the point of impact 44 than the other layers 80 of the apparatus 30. As illustrated in FIG. 2*d*, the exterior layer 100 may have additional components and layers 80 that are to the exterior of the exterior layer 100. The term "exterior" within exterior layer 100 is a relative term used with respect to the elastic layer 200 and the internal layer 300. As illustrated I FIG. 2*d*, the exterior layer 100 is not necessarily the most exterior component of the apparatus 30. Adding additional components to the exterior of the apparatus 30 does not cause the apparatus 30 to cease being the apparatus 30.

The exterior layer 100 is described in greater detail below. In addition to being the first line of defense relative to the elastic layer 200 and interior layer 300 with respect to receiving the impact 44, the exterior layer 100 serves to constrain the position/movement of the elastic structures 210 making up the elastic layer 200. In some embodiments, the exterior layer 100 can itself add some additional magnitude of elasticity to the apparatus 30 by utilizing elastic materials to add to the aggregate "give" in the apparatus 30.

3. Interior Layer

The interior layer 100 often but not always provides for the interior surface 62 of the apparatus 30 as a whole. Thus the interior layer 100 is often the interface between the user 40 and the apparatus 30. In addition to often serving as the interface between user 40 and apparatus 30, the interior layer 100 often serves to constrain the position/motion of the elastic structures 210 comprising the elastic layer 200. As illustrated in FIG. 3*a*, the elastic layer 200 can be sandwiched between the interior layer 300 and the exterior layer 100 in some embodiments of the apparatus 30. In other embodiments, such as the illustration of FIG. 3*b*, the elastic layer 200 is positioned within the interior layer 300. In still other embodiments, such as the illustration of FIG. 2*f*, the elastic layer 200 can be positioned within the exterior layer 100.

The different embodiments and components of the interior layer 100 are discussed in greater detail below.

IV. Detailed Description of Components

The helmet 50 and other embodiments of the apparatus 30 can be implemented in a wide variety of different configurations using a wide variety of different components and materials.

A. Exterior Layer—Shell

Figure 4A:
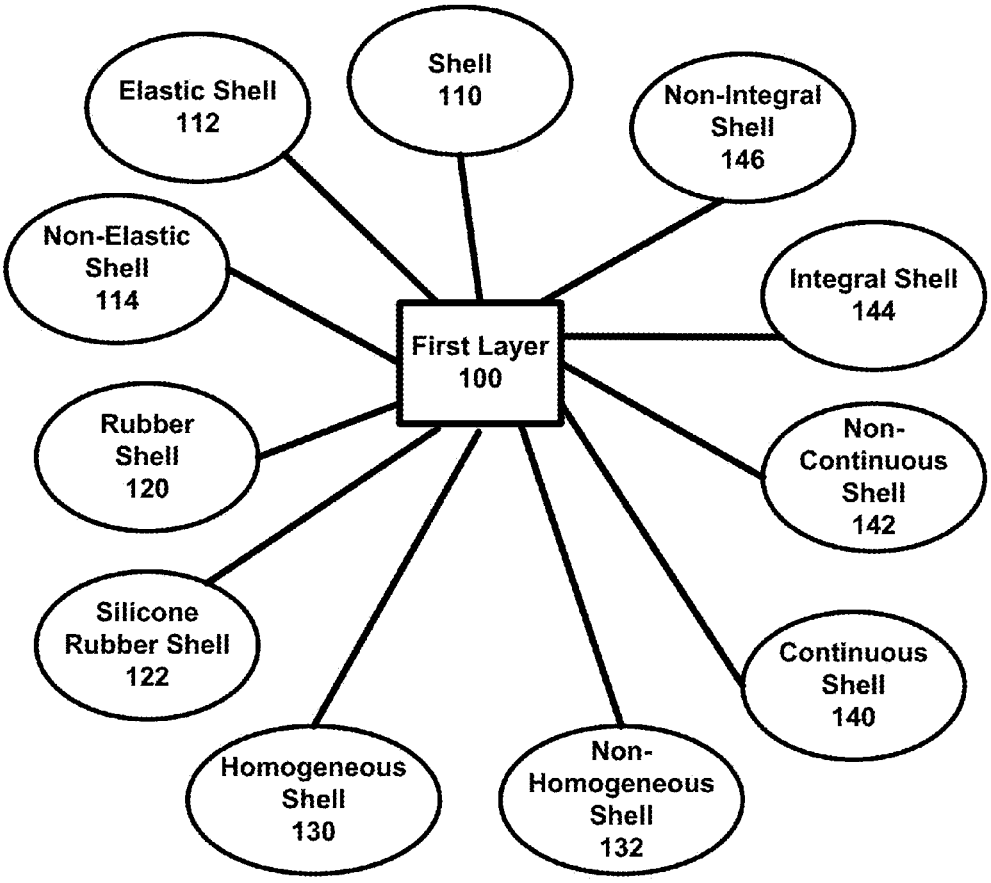
FIG. 4*a* a block diagram illustrating example of different components, attributes, and configurations can make up the external layer of the helmet.

FIG. 4*a* is a block diagram illustrating various potential features of the exterior layer 100. The exterior layer 100 is typically embodied as some type of a shell 110. In a preferred embodiment, the shell 110 is an elastic shell 112 that can add some elasticity to the apparatus 30. For example, an elastic shell 112 could be comprised of a rubber (a rubber shell 120 such as a silicon rubber shell 122), plastic, or similar material. The apparatus 30 does not require the use of an elastic exterior layer 100. A non-elastic shell 114 can be desired in certain embodiments.

The shell 110 can be a homogeneous shell 130 with uniform attributes such as density throughout the shell 110. In other embodiments, the shell 110 can be a non-homogeneous shell 132 with varying density and other properties design to enhance the dissipation process. For example, going from higher density to lower density from the exterior towards to the interior of the shell 110 may be desirable in terms of dissipating the force 44.

The shell 110 can be a continuous shell 140 without gaps or holes or a non-continuous shell 142 that includes gaps or holes for the purposes of air flow, sweat dissipation, or other reasons.

The shell 110 can be implemented as an integral shell 144 with no removable parts of assemblies. The shell 110 can also be implemented as a non-integral shell 146 designed to be capable of disassembly and reassembly by user 40.

Figure 4B:
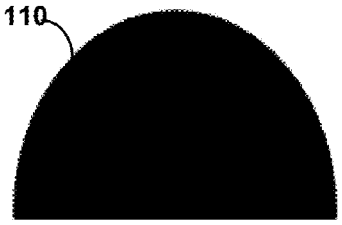
FIG. 4*b* is a diagram illustrating an example of a shell as an external layer.

As illustrated in FIG. 4*b*, the shape of the shell 110 is often going to determine the shape of the helmet 50 or other embodiment of the apparatus 30.

Figure 4C:
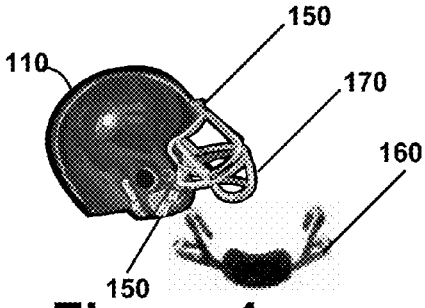
FIG. 4*c* is a diagram illustrating an example of shell with attachment components for the attachment of a facemask and chin guard.

As illustrated in FIG. 4*c*, the shell 110 can include attachment components 150 for additional items such as a facemask 170 of a chin guard 160.

B. Elastic Layer—Elastic Structures

Figure 5A:
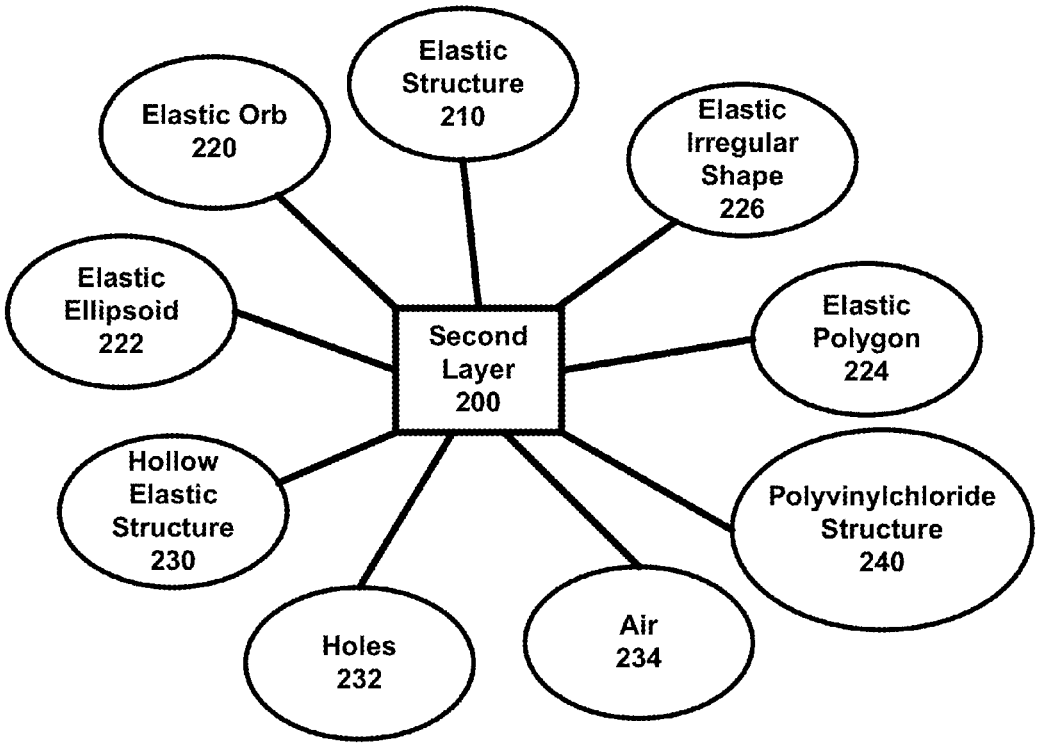
FIG. 5*a* is a block diagram illustrating an example of different components, attributes, and configurations that can be incorporated into a middle elastic layer.

FIG. 5*a* is a block diagram illustrating a variety of different attributes that can be configured into the elastic structures 210 that make up the elastic layer 200.

Elastic structures 210 are at least substantially elastic. Different embodiments of the apparatus 30 can include different numbers, shapes, and sizes of elastic structures 210. In many embodiments, the elastic structures 210 will be at least substantially ellipsoid in shape (i.e. elastic ellipsoids 222) or even substantially spherical in shape (i.e. elastic orbs 220). Other shapes are possible, such as polygons (i.e. elastic polygons 224) or even non-symmetrical and irregular shapes (i.e. elastic irregular shape 226).

In many embodiments, the elastic structures 210 will be hollow elastic structures 230 with holes 232 to permit air 234 to flow in and out of the elastic structures 210. Air flows out the hole 232 when a force 44 strikes the apparatus 30 because the elastic structures 210 compress. Air 234 flows back in mere milliseconds later when the elastic structures 210 recover and expand from their compressed state. The act of compressing/deflating and expanding/inflating can be an effective way to implemented enhanced elasticity, dissipation, and recovery into the apparatus 30.

Elastic structures 210 can be implemented using a wide variety of different materials, with varying degrees of elasticity. Plastic materials, such as a polyvinylchloride structure 240 can be particularly desirable.

Figure 5B:
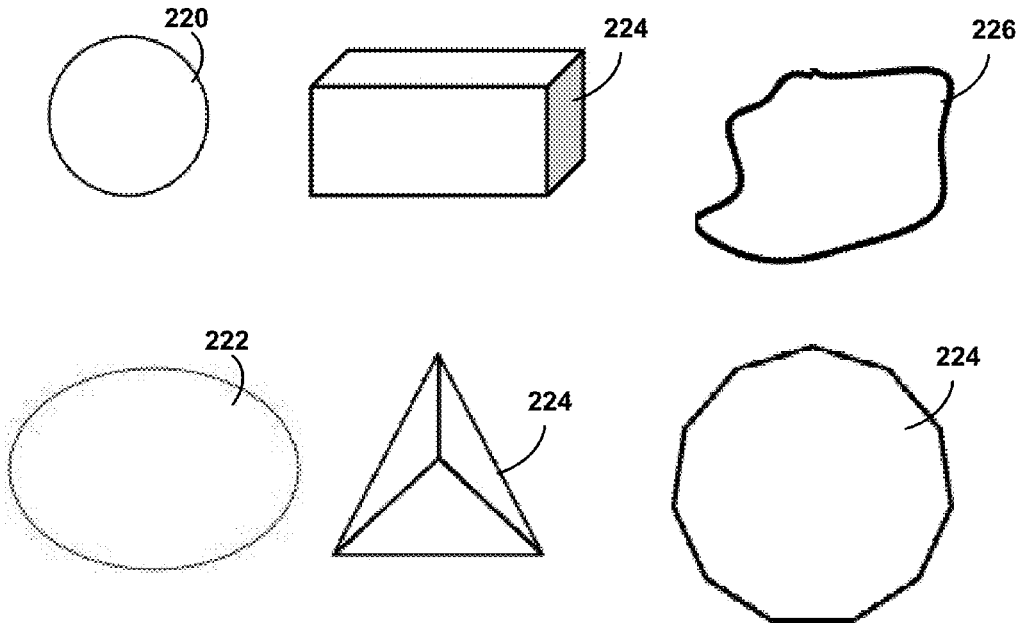

FIG. 5*b* illustrates some but not all of the different shapes of elastic structures 210 that can be utilized by the apparatus 30. Different shapes can be incorporated into the same embodiment of the apparatus 30.

Figure 5C:
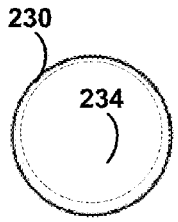
FIG. 5*c* is a diagram illustrating an example of an elastic structure in the form of a substantially hollow and substantially spherical elastic structure.
Figure 5D:
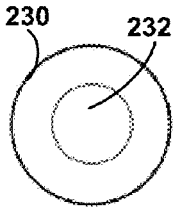
FIG. 5*d* is a diagram illustrating an example of an elastic structure in the form of a substantially spherical elastic structure with a substantially spherical hole/opening.

FIG. 5*c* illustrates an example of a hollow elastic structure 230 with air 234 in the middle. FIG. 5*d* illustrates an example of a hollow elastic structure 230 with a hole 232.

C. Interior Layer—Hollow Sleeves and Non-Hollow Sleeves

Figure 6A:
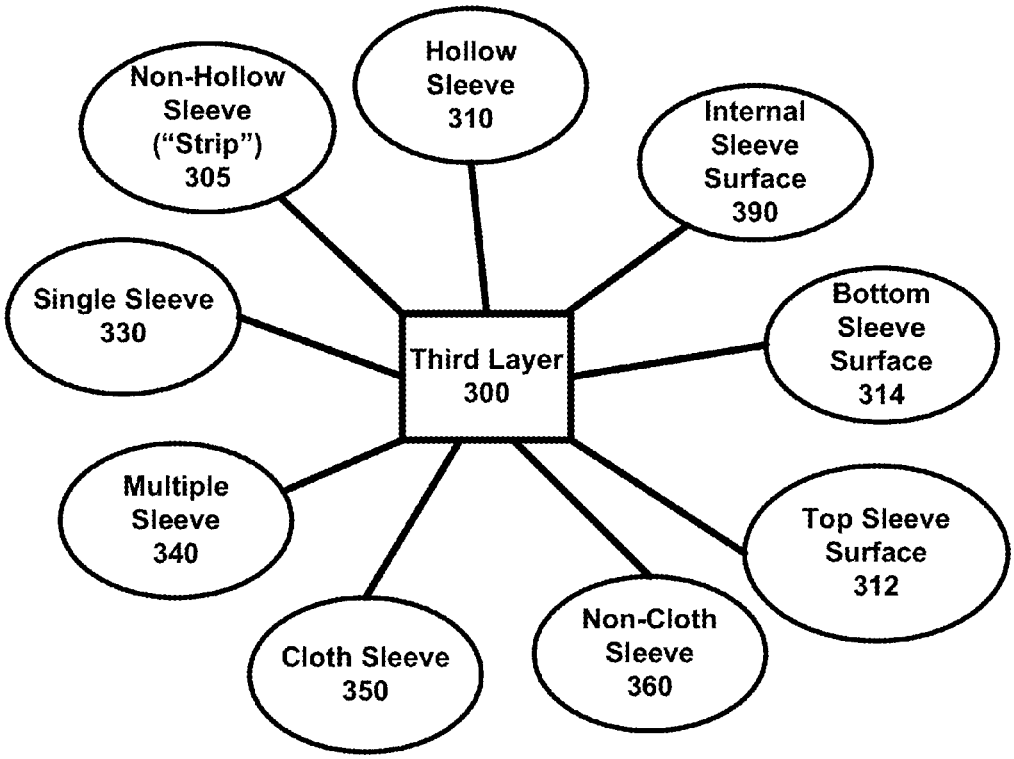
FIG. 6*a* is a block diagram illustrating an example of different components, attributes, and configurations that can be incorporated into an internal layer.

The interior layer 300 typically provides for the interior surface 62. The interior layer 300 (which can also be referred to as a third layer 300) typically serves two purposes: (1) it constrains the position and motion of the elastic structures 210 between the exterior surface 64 and the interior surface of the apparatus 30; and (2) it is the interface between the person or object being protected and the apparatus 30 itself. In the context of a helmet 50, the interior layer 300 is an interface between the helmet 50 and the head 42 of the user 40. As illustrated by FIG. 6*a*, a third layer 300 can be implemented using a wide variety of different sleeves comprised of wide variety of different materials, possessing a wide variety of different shapes, and being implemented in a wide variety of different configurations. As illustrated in FIG. 6*a*, the interior layer 300 can be implemented with hollow sleeves 310 or non-hollow sleeves 305 (i.e. strips 305), single sleeves 330 or multiple sleeves 340, cloth sleeves 350 or non-cloth sleeves 360, etc.

1. Hollow Sleeves Vs. Non-Hollow Sleeves (i.e. Strips)

The apparatus 30 can use hollow sleeves as well as non-hollow sleeves (i.e. strips) as the interior layer 300.

Figure 6B:
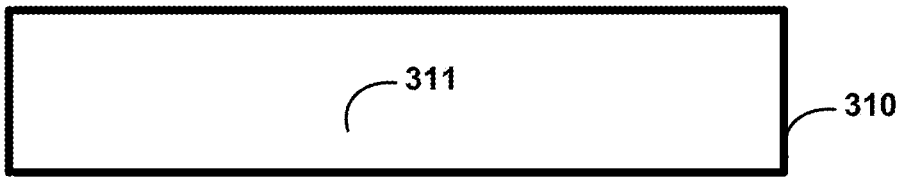
FIG. 6*b* is a diagram of a sleeve with an enclosure or opening for holding elastic structures.
Figure 6C:
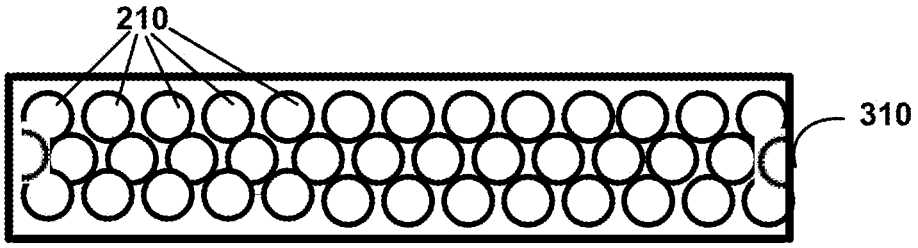
FIG. 6*c* is a diagram of the sleeve of FIG. 6*b* that is filled with elastic structures.

FIG. 6*b* illustrates an example of a hollow sleeve 310 with an enclosure 311. FIG. 6*c* illustrates an example of that same hollow sleeve 310 from FIG. 6*b*, with an enclosure 311 populated with elastic structures 210. FIGS. 2*e*, 2*h*, 2*l*, and 3*b* illustrate similar configurations of elastic structures 210 positioned within the enclosure 311 of a hollow sleeve 310. A hollow sleeve 310 can include a relatively exterior top sleeve surface 312 and a relatively exterior bottom sleeve surface 314. The internal enclosure 311 of the hollow sleeve 310 can be comprised of one or more internal surfaces 390.

Figure 6D:
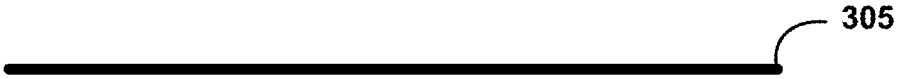
FIG. 6*d* is a diagram of a sleeve without an opening, i.e. a strip.

In contrast to FIGS. 6*b* and 6*c*, FIG. 6*d* illustrates an example of a non-hollow sleeve 305 (i.e. a strip 305). A strip 305 has no enclosure 311 within it. The strip 305 can be used to secure the position of elastic structures 210 between the strip(s) 305 and the exterior layer 100. FIGS. 2*a*, 2*b*, 2*c*, 2*d*, 2*g*, 2*i*, 2*j*, 2*k*, 3*a* and 2*g* are similar examples of such a configuration.

2. Single Sleeve Vs. Multiple Sleeves

Regardless of whether the interior layer 300 involves hollow or non-hollow sleeves, the interior layer 300 can be implemented as a single sleeve 330 or as multiple sleeves 340.

3. Cloth Sleeves Vs. Non-Cloth Sleeves

In the context of a helmet 50, the use of cloth sleeves 350 can be desirable to better allow the dissipation of sweat from the head 42 of the user 40. The apparatus 30 can utilize either cloth sleeves 350 or non-cloth sleeves 360. A wide variety of cloth and non-cloth materials can be utilized in the interior layer 300.

V. Method of Using

The apparatus 30 can dissipate the force 44 of an impact, protecting the person or property that the apparatus 30 that different embodiments of the apparatus 30 can be configured to protect. The "give" in the apparatus 30 can involve the deformation of elastic structures 210 which may for example, temporarily compress in response to the impact of the force 44 impacting the apparatus 30. In some embodiments of the inventive method, the elastic structures 210 are substantially spherical in shape, comprised of polyvinylchloride, hollow, and possessing a hole in the elastic structure 210. Such a configuration utilizes the air within the elastic structures 210 and within the apparatus 30 generally, to dissipate the force 44 of the impact striking the apparatus 30. As discussed above, there are a wide variety of different embodiments of the apparatus 30 that can be used to perform a method of dissipating the force of a flow, which is a method of using the apparatus 30.

A. Example #1

Figure 7A:
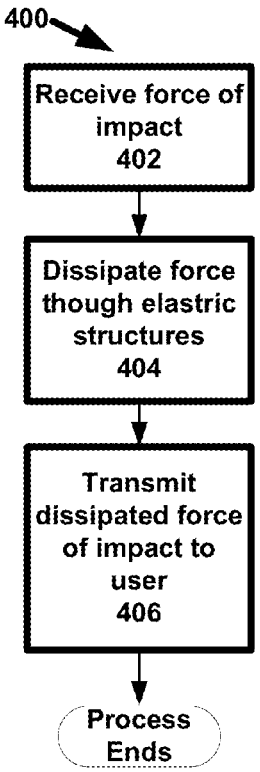
FIG. 7*a* is a flow chart diagram illustrating an example of an impact of force being dissipated as it is transmitted to the wearer of the helmet.

FIG. 7*a* is flow chart diagram illustrating a method 400 of dissipating force 44 using the apparatus 30. The method 400 in FIG. 7*a* can be performed using a wide variety of different components as discussed above and below.

At 402, the impact of the force 44 is received by the apparatus 30. In the context of a football helmet 50, the source of the blow could originate from a wide variety of sources, including but not limited to the helmet of another player, the body of another player, or the act of hitting the ground.

At 404, the impact of the force 44 received by the apparatus 30 at 402 is dissipated through the enhanced elasticity attribute 27 of the apparatus 30, i.e. the elastic structures 210 within the apparatus 30 that deform in response to the force 44. The original force 44 impacting the apparatus 30 at 402 is reduced to a dissipated force 46 as a result of the elastic structures 210 within the apparatus 30.

At 406, the dissipate force 46 is conveyed to user 40 of the protective apparatus 30. In the context of a football helmet 50, there are good reasons to conclude that the dissipated force 46 will be less dangerous to the user 40 of the helmet 50 than the undissipated force 45 transmitted by a prior art helmet 49.

B. Example #2

Recovery Included

Figure 7B:
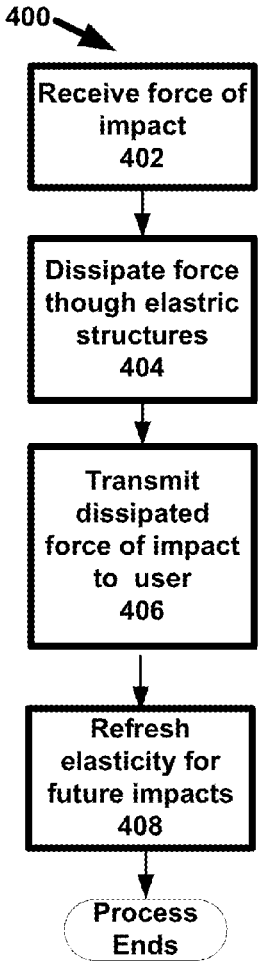
FIG. 7*b* is a flow chart diagram illustrating an example of an impact of force being dissipated as it is transmitted to the wearer of the helmet, with the elastic elements of the helmet recovering and refreshing afterwards.

FIG. 7*b* is a flow chart diagram illustrating a different example of the force dissipation method 400. The functionality at 402, 404, and 406 is identical to what is discussed above and what is also illustrated in FIG. 7*a*. The process of FIG. 7*b* includes a manifestation of the enhanced recovery attribute 29 that is not illustrated in FIG. 7*a*.

At 408, the elasticity of the elastic structures 210 is refreshed so that future impacts of force 44 can also be dispersed. To the extent that the prior art includes examples of helmets with more "give" in them than a convention football helmet, it is believed that such approaches involve less than desired recovery attributes. In other words, such approaches do not involve quick and robust recoveries to enable the protection of a football player who can receive multiple blows to the head in a very short period of time.

VI. Method of Making

Figure 8:
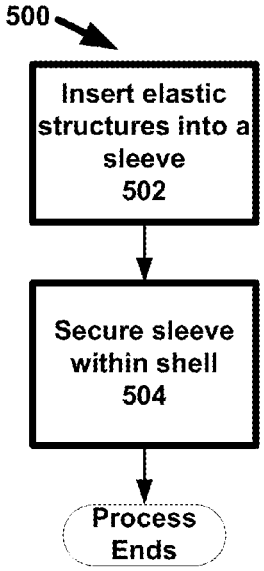
FIG. 8 is a flow chart diagram illustrating an example of manufacturing a helmet by filling a sleeve with elastic structures and then securing the sleeve within the shell of the helmet.

The apparatus 30 can be implemented in a wide variety of different ways using a wide variety of different processes. FIG. 8 is a flow chart diagram illustrating an example of a process 500 for making the apparatus 30 in the context of a football helmet 50 with hollow sleeves 310 filed with elastic structures 210.

At 502, the elastic structures 210 are inserted into the enclosures 311 (or openings 311) of the sleeves 310. A wide variety of different technologies could be used to either permanently or merely temporarily secure the elastic structures 210 within the enclosures 311 of the sleeves 310.

At 504, the sleeves 310 are secured within the shell 110 or other similar manifestation of the exterior layer 100. A wide variety of different technologies could be used to either permanently or merely temporarily secure the sleeves 310 to the shell 110 or other similar manifestation of the exterior layer 100.

VII. Test Results—Objective Measure of Innovation

As discussed in the Overview section above, test data supports the conclusion that the helmet 50 has better elasticity, dissipation, and recovery attributes in comparison to a conventional prior art football helmet 49.

All of the test results discussed above and below involve the use a 16 pound bowling ball, a mannequin, and an accelerometer in the head of the mannequin to measure G forces resulting from the impact of the bowling ball.

A. Test #1—Swing Test

Both the inventive helmet apparatus 50 and a conventional football helmet 49 were subjected to a "swing test". The swing test involved swinging a bowling ball into a helmet-wearing mannequin. The head of the mannequin included an accelerometer for measuring the resulting G forces over time experience by the head of the mannequin underneath the respective innovative helmet 50 and prior art helmet 49.

First, a rope/chord/chain is attached to the bowling ball. Second, the bowling ball is suspended at the same height as the helmet on the mannequin. Third, the bowling ball is pulled back a distance six feet. Fourth, the bowling ball is released, swinging the bowling ball into the head of the mannequin. An accelerometer in the head of the mannequin captures the G forces over time that the head of the mannequin is subjected to.

Figure 1G:
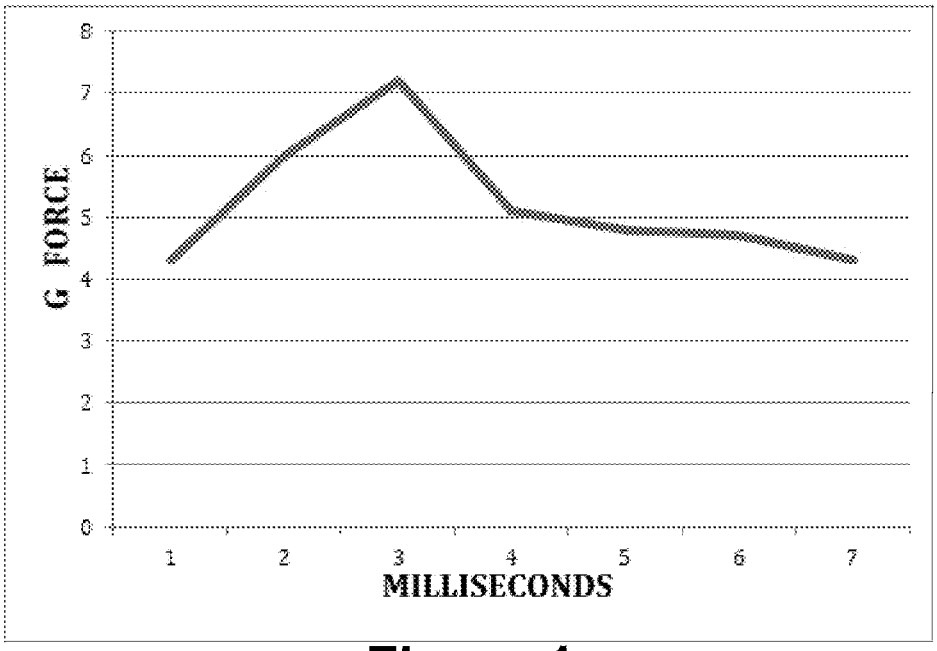
FIG. 1*g* is a graph of G forces over time conveyed to the wearer of the innovative helmet in a swing test.
Figure 1H:
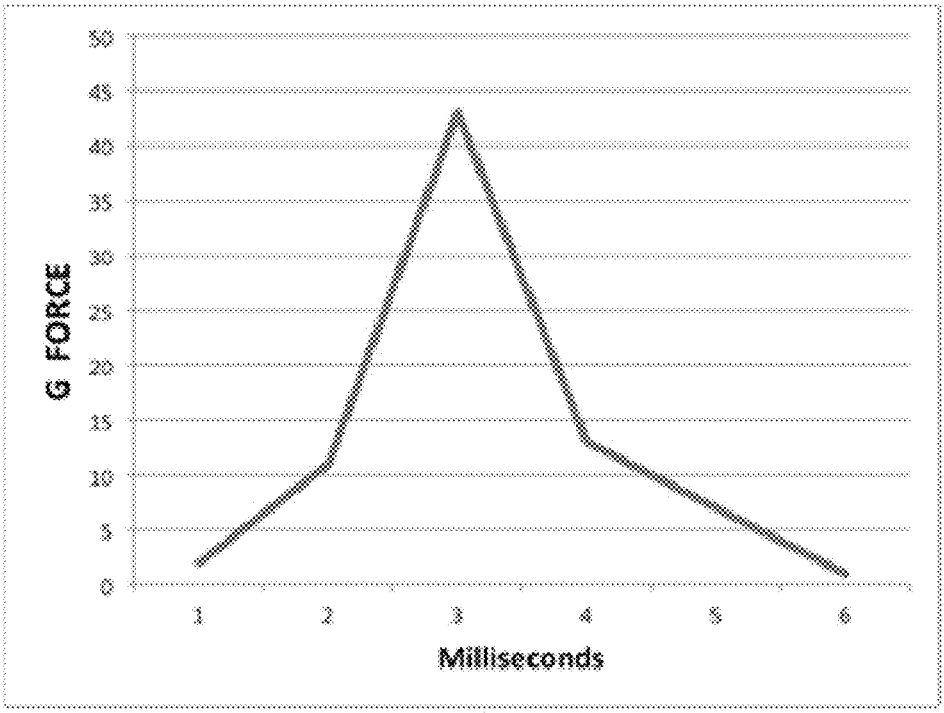
PRIOR ART Figure 1h
FIG. 1*h* is a graph of G forces over time conveyed to the wearer of a prior art helmet subject to the same test conditions as the results of the innovative helmet displayed in FIG. 1*f*.

FIG. 1*g* shows the results of the swing test on the innovative helmet 50. FIG. 1*h* shows the results of the swing test on the conventional prior art football helmet 49. The prior art helmet 49 wearer experienced 6 times the G forces (43 vs. 7) that were experienced by the wearer of the innovative helmet 50. The innovative helmet 50 also took less than ⅓ the time to recover from the heightened G forces. The test results below are summarized above in Table 1.

| Helmet Type | Test Type | Max G Force | Duration | Figure |
|---|---|---|---|---|
| Innovative 50 | Swing | 7 | 4 ms | 1g |
| Prior Art 49 | Swing | 43 | 14 ms | 1h |

B. Test #2—Drop Test

The innovative helmet 50 and the conventional prior art football helmet 49 were also subjected to a drop test" in which the same 16 pound bowling ball was dropped on the head of the mannequin from a height 3 feet and 6 inches above the head of the mannequin.

Figure 1I:
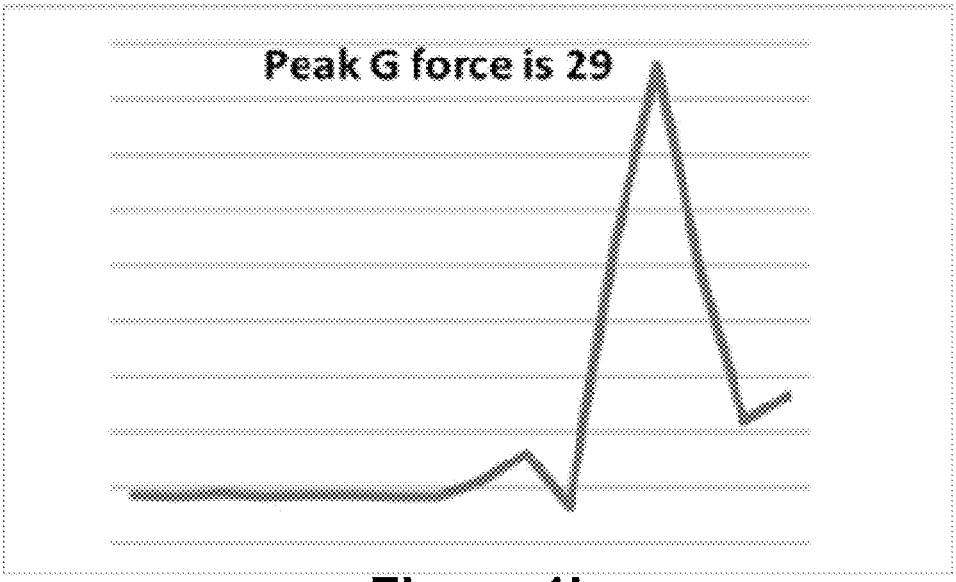
FIG. 1*i* is a graph of G forces conveyed to a wearer of the innovative helmet in a drop test.
Figure 1J:
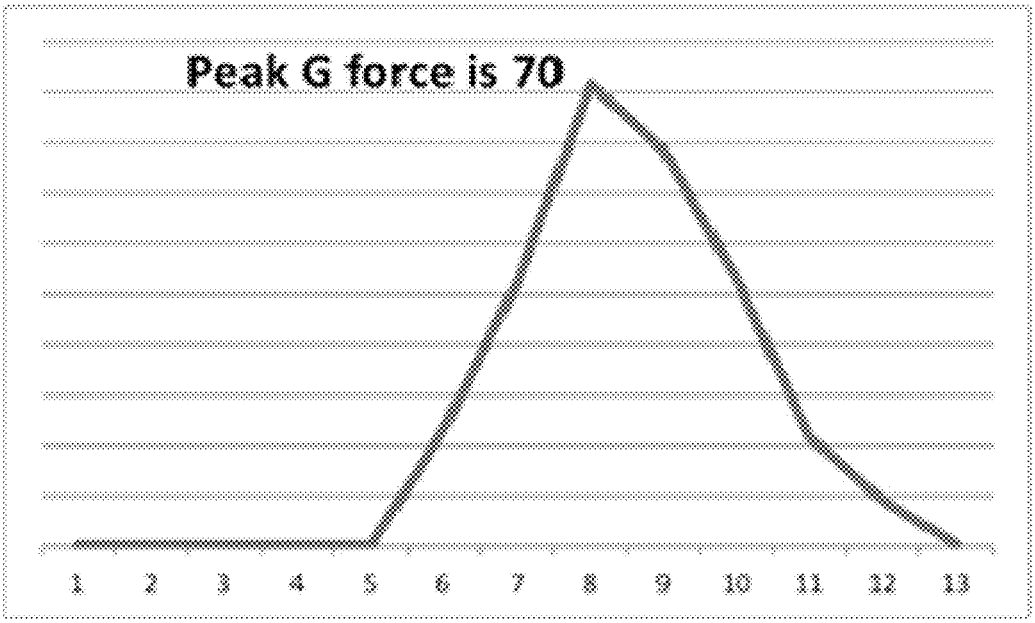
PRIOR ART Figure 1j
FIG. 1*j* is a graph of "G forces" conveyed to a wearer of a prior art helmet in the same test conditions as the results of the innovative helmet displayed in FIG. 1*i*.
Figure 1K:
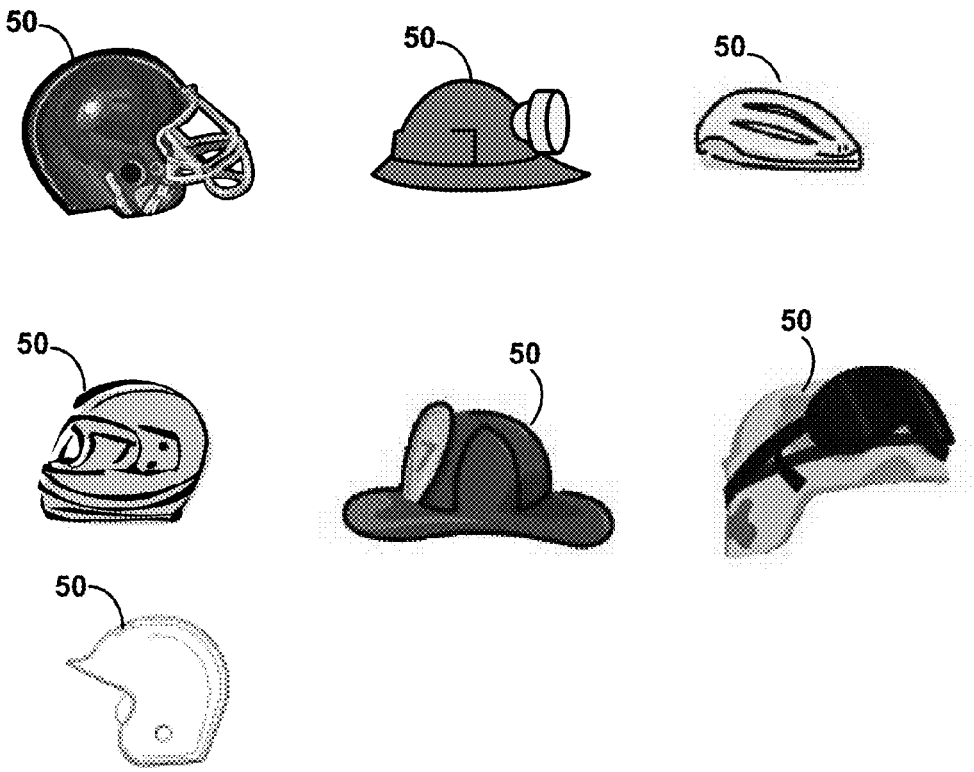
FIG. 1*k* is a diagram illustrating different examples of helmet embodiments of the apparatus.

FIG. 1*i* shows the results of the drop test on the innovative helmet 50. FIG. 1*j* shows the results of the drop test on the conventional prior art football helmet 49. The prior art helmet 49 wearer experienced more than double the G forces (70 vs. 29) that were experienced by the wearer of the innovative helmet 50. The innovative helmet 50 also took substantially less time to recover from the heightened G forces. The test results below are summarized above in Table 1.

| Helmet Type | Test Type | Max G Force | Duration | Figure |
|---|---|---|---|---|
| Innovative 50 | Drop | 29 | 7 ms | 1i |
| Prior Art 49 | Drop | 70 | 10 ms | 1j |

VII. Glossary/Index

As discussed above, the apparatus 30 can be implemented in a wide variety of different ways for a wide variety of different purposes. The original motivation behind the development of the apparatus 30 was a football helmet 50 that would better protect the players from head injuries such as concussions.

In developing the initial football helmet 50, it was determined that dissipating the impacting force 44 impacting the helmet 50 (i.e. the G forces resulting from a blow to the head 42 of the user 40) can be an effective way to protect football players from injury. Force 44 that is dissipated elsewhere is force 44 that will not be applied to the brain of the user 40 of the helmet 50. The use of elastic structures 210 within the helmet 50 can collapse and expel air upon impact, and then mere milliseconds later, return to their original shape while inhaling air to refill the elastic structures 210 with air 234. To facilitate this functionality, it can be preferable to utilize hollow elastic structures 230 with holes 232 that provide for the movement of air 234 out of and then back into the elastic structures 210.

It will often be desirable to position a shell 110 to the exterior of the elastic structures 210 that is an elastic shell 112. To the interior of the elastic structures 210, in can be desirable to utilize sleeves such as hollow sleeves 310 or non-hollow sleeves 305 (i.e. strips 305) to constrain the motion and position of the elastic structures 210 with respect to the shell 210.

As discussed above, the concepts in the football helmet 50 are applicable to other types of helmets 50 as well as to other embodiments of wearable embodiments 31 such as padding embodiments 35 as well as to non-wearable embodiments 32 such as equipment embodiments 34 and structural embodiments 33. The terms used throughout the text of this text of this application, including but not limited to the claims, are defined in the Table 2. Unless otherwise specified in Table 2 below, terminology is not limited to or specific to helmet 50 embodiments of the apparatus 30.

TABLE 2 below provides a glossary of element numbers, element names, and element descriptions.

| Element Number | Element Name | Element Description |
|---|---|---|
| 27 | "Enhanced Elasticity Attribute" | Elasticity means flexibility, resilience, and adaptability. Elastic substances can have their shape changed by application of a load or force, and then return to their original form upon removal of the load or force. The apparatus 30 can include components with an enhanced elasticity attribute 27 in relation to comparable prior art applications. The original inspiration for the conception of the apparatus 30 was a helmet 50 that has an enhanced elasticity attribute 27 in comparison to a prior art helmet 49. In contrast, a conventional prior art football helmet 49 is purposely rigid, the opposite of elastic. |
| 28 | "Enhanced Dissipation Attribute" | Dissipation means a process my which energy is dispersed or scattered. The function of the apparatus 30 is to dissipate force 44 as a means of protection. The apparatus 30 can include components with an enhanced dissipation attribute 28 in relation to comparable prior art applications. The original inspiration for the apparatus 50 was a helmet 50 that could protect the head 42 of a user 40. By dissipating the force 44 away from the head 42 of the user 40, the user 40 can be protected from concussions and other negative ramifications of a blow to the head 42. |
| 29 | "Enhanced Recovery Attribute" | Recovery is an attribute of elasticity, and it can pertain to magnitude (i.e. how far can something elastic can bend without breaking) and/or time (i.e. how quickly the elastic substance can resume its original form after the load or force is removed). In the context of a helmet 50 such as a football helmet 50, the user 40 can be hit multiple times in a short period of time. Thus an apparatus 30 with an enhanced recovery attribute 29 is superior to a one-and-done approach which fails to protect the user 40 after the initial blow. To the extent that some prior art helmets 49 involve greater elasticity than a conventional football helmet, the inventive apparatus 30 can possess an enhanced recovery attribute 29 with respect to such approaches. |
| 30 | "Apparatus" | A device, assembly, or structure that utilizes an arrangement of elastic structures 210 in between an exterior surface 64 and an interior surface 62. The apparatus 30 can be implemented in a wide variety of embodiments, including wearable embodiments 31 such as a helmet 50 that can be worn on the head 42 of the user 40 as well as non-wearable embodiments 32. Elastic structures 210 positioned in the space between the interior surface 62 and the exterior surface 64 enable the apparatus 30 to dissipate the impact of a force 44 striking the apparatus 30. |
| 31 | "Wearable Embodiment" | An embodiment of the apparatus 30 that is worn by a user 40. Examples of wearable embodiments 31 include helmet embodiments 50 (which can also be referred to as helmets 50) and padding embodiments 35 (which can also be referred to as padding 35). |
| 32 | "Non-Wearable Embodiment" | An embodiment of the apparatus 30 that is not worn by a user 40. Non-wearable embodiments 32 can include embodiments of the apparatus 30 that are used in conjunction with movable equipment (an equipment embodiment 34) and embodiments of the apparatus 30 that are used in conjunction with fixed structures (a structural embodiment 33). |
| 33 | "Structural Embodiment" | An embodiment of the apparatus 30 that is used in the context of a playing field, playground floor, gym wall, a shop floor, or some similar surface or context. |
| 34 | "Equipment Embodiment" | An embodiment of the apparatus 30 that is used in the context of equipment, rather than a human user 40. Examples of equipment embodiments can include industrial equipment, exercise equipment, recreational equipment, and other types of equipment. |

TABLE 2-continued below provides a glossary of element numbers, element names, and element descriptions.

| Element Number | Element Name | Element Description |
|---|---|---|
| 35 | "Padding Embodiment" | An embodiment of the apparatus 30 that is worn by a user 40 but is not worn on the head 42 of the user 40. Padding 35 can be worn on the arms, legs, hands, feet, torso, or anywhere else on the user 40 except for the head 42. |
| 40 | "User" | A living organism possessing a head 42 that wears the helmet apparatus 50. The user 40 is typically a human being, but other animals could potentially benefit from the helmet apparatus 50 in certain contexts. |
| 42 | "Head" | The upper part of the body of a user 40 that is attached to the rest of the body of the user 40 through a neck. |
| 44 | "Force" | An impact striking the helmet apparatus 50. The purpose of the helmet apparatus 50 is to protect the user 40 from the impact of a force 44 by dispersing that force 44 through the various components of the helmet 50. The helmet 50 can be described as a method of dispersing the impact of a force 44 striking the helmet 50. Force (F) is equal to mass (m) times acceleration (a), and can be express in the equation F = ma. |
| 45 | "Undissipated Force" | Force 44 impacting a prior art helmet 49 that is not dissipated by the prior art helmet 49. |
| 46 | "Dissipated Force" | Force 44 impacting a prior helmet 49 that is dissipated by the helmet 50. |
| 49 | "Prior Art Helmet" | Any helmet technology that predates the invention of the helmet 50. The original inspiration for the conception of the helmet 50 came in the context of football helmets. |
| 50 | "Helmet Apparatus" or "Helmet" | A protective device worn on the head 42 of a user 40 that protects the head 42 of the user 40 from an impacting force 44. The force 44 that would otherwise strike the head 42 of the user 40 can be dispersed by the helmet 50, protecting the user 40 from concussions and other undesirable results. The helmet 50 can be implemented in a wide variety of different ways for a wide variety of different contexts. The original inspiration for the apparatus 30 was for use as a football helmet 50 to prevent concussions, but the helmet 50 can be implemented as a wide variety of different sport helmets, industrial helmets, and other types of helmets. |
| 60 | "Surface" | A face or boundary. The helmet 50 and other embodiments of the apparatus 30 can include a variety of different surfaces 60, including but not limited to an interior surface 62 and an exterior surface 64. |
| 62 | "Interior Surface" | A surface 60 closest to what is being protected by the apparatus 30 and furthest from the impact of the force 44 striking the apparatus 30. In the context of a helmet 50, the interior surface 62 is closest to the head 42 of the user 40 relative to the other components of the helmet 50 described in this glossary/index. The interior surface 62 can be comprised of a wide variety of different materials in a wide variety of different geometric shapes. For example, the interior surface 62 can be comprised of plastic, rubber, nylon, cloth, and other substances. Different interior surfaces 62 can have different characteristics in terms of gas permeability and liquid permeability. For example, the interior surface 62 can be comprised of a cloth material that provides for the carrying away of moisture from the user 40. The interior surface 62 is typically either one or more strips 305, or one or more sleeve bottom surfaces 314. |
| 64 | "Exterior Surface" | A surface 60 closest to the force 44 striking the apparatus 30 and further from what is being protected by the apparatus 30. In the context of a helmet 50, the exterior surface 64 is further away from the head 42 of the user 40 relative to the other components of the helmet 50. It is the exterior surface 64 that provides for receiving the impact of |

TABLE 2-continued below provides a glossary of element numbers, element names, and element descriptions.

| Element Number | Element Name | Element Description |
|---|---|---|
| | | force 44 from the outside world that can then be dispersed for the safety of the user 40. The exterior surface 64 can be comprised of a wide variety of different materials, including rigid materials, semi-elastic materials, substantially elastic materials, or even fully elastic materials. The exterior surface 64 can be non-homogeneous, semi-homogeneous, substantially homogeneous, or fully homogeneous. The exterior surface 64 can be fully continuous, substantially continuous, or merely semi-continuous in terms of possessing gaps in the surface. Different levels of liquid and gas permeability can be incorporated into the exterior surface. The exterior surface 64 is typically the outer surface of the shell 110. |
| 80 | "Layer" | A level of material. The helmet 50 can be implemented in a wide variety of different embodiments and configurations. The terms "exterior", "middle", and "interior" in exterior layer 100, middle layer 200, and interior layer 300 are references to relative positions with respect to each other and do not necessarily represent absolute positions on the helmet 50. For example, additional components could be added to the interior of any of the three layers 80, to the exterior of any of the three layers 80, or in between any of the three layers 80. |
| 100 | "First Layer" or "Exterior Layer" | A layer 80 of the helmet that is exterior to a second layer 200 and a third layer 300. The first layer 100 will often include the exterior surface 64. |
| 110 | "Exterior Shell" or "Shell" | A component of the helmet 50 that is a protective outer covering. The first layer 100 is often comprised of an exterior shell 110 that is often at least semi-elastic and semi-homogeneous. To aid in the dispersion process, the exterior shell 110 can be incrementally less dense in the interior/inward direction. The exterior shell 110 can be comprised of a wide variety of different materials and different material configurations. The shell 110 can be elastic or non-elastic, homogeneous or non-homogeneous, continuous or non-continuous, an integrated whole or a configuration of parts, etc. The shell 110 can be made up of rubber, including but not limited to a silicone rubber, as well as a wide variety of different materials. The shell 110 can be implemented in a wide variety of different shapes. |
| 112 | "Elastic Shell" | A shell 110 that is comprised of an at least semi-elastic material. The apparatus 30 utilizes elastic structures 210 beneath the shell 110 as a primary source of the enhanced elasticity attribute 27, but in some contexts it is also beneficial to have a somewhat elastic or even substantially elastic shell 110. |
| 114 | "Non-Elastic Shell" or "Rigid Shell" | The apparatus 30 can utilize a shell 110 that is rigid. For example, in the context of a helmet 114, the innovative elastic structures 210 can be positioned under rigid shell 110 that is indistinguishable from a conventional prior art football helmet 49. Such an embodiment may not be optimal, but such a helmet 50 can still be superior to a conventional prior art football helmet 49. |
| 120 | "Rubber Shell" | A shell 110 comprised at least in part by a rubber. |
| 122 | "Silicone Rubber Exterior Shell" | A rubber shell 120 that is comprised at least in part with a silicone rubber. |
| 130 | "Homogeneous Shell" | A shell 110 that is at least substantially uniform in structure and composition. |
| 132 | "Non-Homogeneous Shell" | A shell 110 that is not a homogeneous shell 130. |
| 140 | "Continuous Shell" | A shell 110 that is without gaps or holes. |
| 142 | "Non-Continuous Shell" | A shell 110 that is not a continuous shell 140. |
| 144 | "Integral Shell" | A shell 110 that is an integrated whole without components intended to be removable. |
| 146 | "Non-Integral Shell" | A shell 110 that is not an integral shell 144. |

TABLE 2-continued below provides a glossary of element numbers, element names, and element descriptions.

| Element Number | Element Name | Element Description |
|---|---|---|
| 150 | "Attachment Mechanism" | In some embodiments of the helmet 50, it will be desirable to attach additional components to the helmet 50. For example, in the context of a football helmet, a chin guard/strap 160 and a facemask 170 are often desired. By way of further example, in the context of a miner, it may be desirable to attach a light source to the exterior of the helmet 50. An attachment mechanism 150 is a component that is attached to the helmet 50 that provides for the attachment of such additional components. |
| 160 | "Chin Guard" or "Chin Strap" | A component of a helmet 50 that protects the chin of the user 40. |
| 170 | "Face Mask" | A component of a helmet 50 that protects the face of the user 40. |
| 200 | "Second Layer" or "Middle Layer" | A layer 80 of the helmet that is relatively positioned between the exterior layer 100 and the interior layer 300. The second layer 200 is populated with elastic structures 210 for the purposes of dispersing the force 44 impacting the helmet 50. |
| 210 | "Elastic Structure" | An item that is at least semi-elastic and often at least substantially elastic or even fully elastic. Elastic structures 210 help disperse the impact of a force 44 striking the helmet 50. The apparatus 30 can include a wide variety of different numbers and types of elastic structures 210. Elastic structures 210 can be comprised in wide variety of different shapes and made of a wide variety of materials. In many embodiments, elastic structures 210 will be free moving, i.e. not attached to any other elastic structure 210 and not attached to any other component of the helmet 50. |
| 220 | "Elastic Orb" | An elastic structure 210 that is at least substantially spherical in shape. |
| 222 | "Elastic Ellipsoid" | An elastic structure 210 that is at least substantially ellipsoid in shape. |
| 224 | "Elastic Polygon" | An elastic structure 210 that is at least substantially in the shape of a polygon. |
| 226 | "Elastic Irregular Shape" | An elastic structure 210 that is embodied in a non-symmetrical and otherwise irregular shape. |
| 230 | "Hollow Elastic Structure" | An elastic structure 210 that is at least substantially hollow. |
| 232 | "Hole" | An opening. Many embodiments of the elastic structures 210 that are hollow elastic structures 230 will include one or more holes 232 in the outer surface. Such embodiments can be particularly effective in the process of dispersing force 44. |
| 234 | "Air" | A mix of gasses that is at least substantially similar to the mixture encountered on the earth at ground level. Many embodiments of hollow elastic structures 230 can have air 234 within them. |
| 240 | "Polyvinyl chloride structure" | An elastic structure 210 comprised of a water-insoluble thermoplastic resin that is derived from the polymerization of vinyl chloride. |
| 300 | "Third Layer" or "Interior Layer" | A layer 80 of the helmet that is relatively positioned so that the interior-most surface 80 of the interior layer 300 is interior relative to the first layer 100 and second layer 200. The third layer 300 is typically comprised of one or more strips 305 or one or more sleeves 310. |
| 305 | "Strip" or a "Non-Hollow Sleeve" | A relatively thin piece of material that does not include a space within itself for the purposes of holding any other component. A strip 305 can be referred to as a sleeve 310 without an enclosure 311. A strip 305 is a type of sleeve 310 that does not include an enclosure 311. Thus, an interior surface 62 that is not a bottom sleeve surface 314 is a strip 305. Strips 305 can be made up of any material that can be used within the interior surface 62, including but not limited to cloth material which provides for drawing away moisture from the user 40. Unlike a sleeve 310, a strip 305 does not include a space within it for holding elastic structures 210. Strips 305 constrain the movement of elastic structures 210 between the one or more strips 305 and the shell 110 or other structure of the first layer 100. |

TABLE 2-continued below provides a glossary of element numbers, element names, and element descriptions.

| Element Number | Element Name | Element Description |
|---|---|---|
| 310 | "Sleeve" | A sleeve 310 is similar to strip 305, except that a sleeve 310 includes a space 311 within itself for holding the elastic structures 210. A sleeve 310 can thus also be referred to as a sheath or a hollow sleeve 310. A sleeve 310 can be constructed by combining two strips 305 together such that there remains an enclosure 311 between them capable of holding the elastic structures 210. |
| 311 | "Opening" or "Enclosure" | Space between the top sleeve surface 312 and the bottom sleeve surface 314. |
| 312 | "Top Sleeve Surface" or "Sleeve Top Surface" | The exterior facing surface of the sleeve 310. |
| 314 | "Bottom Sleeve Surface" or "Sleeve Bottom Surface" | The interior facing surface of the sleeve 310. This is typically the interior surface 62 of the helmet apparatus 50 as a whole. |
| 330 | "Single Sleeve" | A sleeve 310 that is not one of multiple sleeves 340. Both hollow sleeves 310 and non-hollow sleeves 305 can be implemented in single sleeve 330 embodiments. A non-hollow sleeve 305 (a strip 305) in a single sleeve 330 embodiment can be referred to as a "sheet". |
| 340 | "Multiple Sleeve" | A sleeve 310 that is one of many sleeves 310. Many embodiments of the apparatus 30 will include multiple sleeves 340. Both hollow sleeves 310 and non-hollow sleeves 305 can be implemented in multiple-sleeve 340 embodiments |
| 350 | "Cloth Sleeve" | A sleeve 310 comprised of a cloth material. Both hollow sleeves 310 and non-hollow sleeves 305 can be comprised of cloth material. |
| 360 | "Non-Cloth Sleeve" | A sleeve 310 that is not a cloth sleeve 350. |
| 400 | "Force Dissipation Method" | A method for distributing force 44 over a wider area of space for the purposes of dissipating the impact of that force 44 on the apparatus 30. |

The invention claimed is:

1. A helmet (50) that provides for being worn on a head (42) of a user (40) to protect the head (42) of the user (40) from an application of force (44), said helmet (50) comprising:

a plurality of surfaces (60), said plurality of surfaces (60) including:

an interior surface (62) and an exterior surface (64);

wherein said interior surface (62) provides for being in relatively closer proximity to the head (42) of the user (40) wearing said helmet (50) than said exterior surface (64); and wherein said exterior surface (64) provides for being in relatively closer proximity to the application of force (44) impacting said helmet (50) than said interior surface (62);

a plurality of at least substantially elastic structures (210) positioned between said interior surface (62) and said exterior surface (64), said plurality of at least substantially elastic structures (210) including a plurality of holes (232).

2. The helmet (50) of claim 1, wherein said plurality of at least substantially elastic structures (210) are a plurality of at least substantially hollow elastic structures (230), and wherein said plurality of holes (232) provide for the movement of a quantity of air (234) from the inside of said at least substantially hollow elastic structures (230) to the outside of said at least substantially hollow elastic structures (230).

3. The helmet (50) of claim 1, said helmet (50) further comprising a sleeve (310);

said sleeve (310) including an enclosure (311), a top sleeve surface (312), and a bottom sleeve surface (314);

wherein said bottom sleeve surface (314) is at least a portion of said interior surface (62) of said helmet (50); and wherein said enclosure (311) provides for holding said plurality of at least substantially elastic structures (210), wherein said plurality of at least substantially elastic structures (210) are hollow (232).

4. The helmet (50) of claim 1, said helmet (50) further comprising a plurality of sleeves (310);

said plurality of sleeves (310) including a plurality of enclosures (311) a plurality of top sleeve surfaces (312), and a plurality of bottom sleeve surfaces (314), said plurality of sleeves including a first sleeve (310) and a second sleeve (310), wherein said first sleeve (310) is touching said second sleeve (310);

wherein said interior surface (62) of said helmet (50) is at least partially comprised of said bottom sleeve surfaces (314); and wherein said plurality of enclosures (311) provide for holding said plurality of at least substantially elastic structures (210) between said exterior surface (64) and said interior surface (62).

5. The helmet (50) of claim 4, wherein said plurality of sleeves (310) fully enclose said plurality of at least substantially elastic structures (210), and wherein said plurality of sleeves (310) are at least partially comprised of a cloth material that provides for the carrying away of moisture from the user (40).

6. The helmet (50) of claim 1, wherein said plurality of at least substantially elastic structures (210) provide for compressing in more than one direction.

7. The helmet (50) of claim 1, wherein no said at least substantially elastic structure (210) is even indirectly connected to any other said at least substantially elastic structure (210).

8. The helmet (50) of claim 1, wherein said plurality of at least substantially elastic structures (210) are at least substantially ellipsoid (222) in shape.

9. The helmet (50) of claim 8, wherein said plurality of at least substantially elastic structures (210) are at least substantially hollow (230) and include a hole (232).

10. The helmet (50) of claim 1, said plurality of at least substantially elastic structures including a first structure (210) and a second structure (220), wherein said first structure (210) is not fixed to said second structure (210).

11. The helmet (50) of claim 1, wherein said plurality of at least substantially elastic structures (210) are freely moving within an enclosure (311) positioned between said interior surface (62) and said exterior surface (64), wherein said plurality of at least substantially elastic structures are comprised of a polyvinyl chloride (240), and wherein said plurality of at least substantially elastic structures provide for dissipating the force (44) by compressing a plurality of air (234) within the said plurality of at least substantially elastic structures.

12. The helmet (50) of claim 11, wherein plurality of at least substantially elastic structures provide for uncompressing in less than about 1 second to provide for dissipating a subsequent force.

13. The helmet (50) of claim 1, wherein said plurality of at least substantially elastic structures (210) are a plurality of at least substantially hollow structures (230), wherein said plurality of holes (232) provide for the movement of a quantity of air (234) into and out of said plurality of at least substantially hollow structures (230), wherein said plurality of at least substantially elastic strictures (210) are at least substantially ellipsoid (222) in shape, wherein said plurality of at least substantially elastic structures (210) are positionally constrained in a plurality of cloth sleeves (350) within said helmet (50), and wherein said plurality of cloth sleeves (350) are at least partially air permeable.

14. The helmet (50) of claim 1, said helmet (50) further comprising an external shell (110) and a sleeve (310);

wherein said exterior surface (64) of said helmet is comprised of said external shell (110);

wherein said sleeve (310) includes a top sleeve surface (312), a bottom sleeve surface (314), and an enclosure (311) that are positioned to the interior of said shell (110) and said exterior surface (64).

15. A helmet (50) that provides for being worn on a head (42) of a user (40) to protect the head (42) of the user (40) from an application of force (44), said helmet (50) comprising:

a plurality of surfaces (60), said plurality of surfaces (60) including:

an interior surface (62) that provides for being in close proximity to the head (42) of the human being (40) wearing the helmet (50); and an exterior surface (64) that provides for being in close proximity to application of force (44) impacting said helmet (50);

an exterior shell (110) that includes said exterior surface (64) of said helmet (50);

a sleeve (310) that is at least substantially air permeable, said sleeve (310) including an enclosure (311), a top sleeve surface (312) and a bottom sleeve surface (314), wherein said interior surface (62) of said helmet is at least partially comprised of said bottom sleeve surface (314);

a plurality of at least substantially elastic structures (210) positioned within said enclosure (311) that is within said sleeve (310), wherein said plurality of at least substantially elastic structures (210) are positionally constrained within said sleeve (310) without being connected to said sleeve (210), and wherein said plurality of at least substantially elastic structures (210) are positioned between said interior surface (62) and said exterior surface (64); and a plurality of holes (232) in said plurality of at least substantially elastic structures (210).

16. The helmet (50) of claim 15, further comprising a plurality of sleeves (310) that include a plurality of enclosures (311), a plurality of top sleeve surfaces (312), and a plurality of bottom sleeve surfaces (314);

said plurality of sleeves (310) including a first sleeve (310) and a second sleeve (310), wherein said first sleeve (310) touches said second sleeve (310);

wherein said interior surface (62) of said helmet (50) is comprised of said plurality of bottom sleeve surfaces (314); and wherein said plurality of at least substantially elastic structures (210) are contained in said plurality of enclosures (311).

17. The helmet (50) of claim 15, said plurality of at least substantially elastic structures (210) include a first structure (210) and a second structure (210), wherein said first structure (210) provides for being in direct physical contact with said second structure (210) when said first structure (210) and said second structure (220) are in uncompressed states, wherein said first structure (210) is not connected to said second structure (210), and wherein the position of said first structure (210) can change relative to the position of said second structure (210).

18. The helmet (50) of claim 15, wherein said plurality of at least substantially elastic structures (210) are a plurality of at least substantially hollow structures (230), wherein said plurality of holes (232) permit a quantity of air (234) to move from within said at least substantially hollow structures (230) through said holes (232) to the outside of said at least substantially hollow structures (230) when said at least substantially hollow structures (230) are compressed.

19. The helmet (50) of claim 15, wherein said plurality of said at least substantially elastic structures (210) provide for uncompressing in less than 50 milliseconds to provide for dissipating a subsequent force.

20. A helmet (50) that provides for being worn on a head (42) of user (40) that provides for protecting the user (40) from an application of force (44) impacting the helmet (50), said helmet (50) comprising:

a plurality of surfaces (60), said plurality of surfaces (60) including:

an interior surface (62) closest to the head (42) of the user (40);

an exterior surface (64) that provides for directly receiving the application of force (44); and an exterior shell (110), said exterior shell (110) including said exterior surface (64) of said helmet (50);

a sleeve (310), said sleeve (310) including an enclosure (311), a sleeve bottom surface (314) and a sleeve top surface (312);

a plurality of at least substantially elastic structures (210) positioned within said enclosure (311); and a plurality of holes (232);

wherein said plurality of at least substantially elastic structures (210) include a plurality of at least substantially hollow structures (230) that include said plurality of holes (232) that allow for the movement of a quantity of air (234) into and out of said at least substantially hollow structures (230).

* * * * *